US007178195B2

(12) United States Patent
Damrath et al.

(10) Patent No.: US 7,178,195 B2
(45) Date of Patent: Feb. 20, 2007

(54) DEVICE FOR WRINGING A MOP AND FLOOR CLEANING SYSTEM HAVING THE DEVICE

(75) Inventors: Joachim Damrath, Bachhagel (DE); Markus Spielmannleitner, Ellwangen (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/191,279

(22) Filed: Jul. 25, 2005

(65) Prior Publication Data

US 2006/0016041 A1 Jan. 26, 2006

Related U.S. Application Data

(63) Continuation of application No. PCT/EP2003/013586, filed on Dec. 2, 2003.

(30) Foreign Application Priority Data

Dec. 2, 2002 (DE) ..... 10 256 089
Dec. 2, 2002 (DE) ..... 10 256 091
Dec. 2, 1920 (DE) ..... 10 256 090

(51) Int. Cl.
*A47L 13/14* (2006.01)

(52) U.S. Cl. ..... 15/228; 15/244.1; 15/262; 68/43; 68/94; 100/74; 100/155 R; 100/155; 100/176

(58) Field of Classification Search ..... None
See application file for complete search history.

(56) References Cited

U.S. PATENT DOCUMENTS 612,842 A * 10/1898 Griffith ..... 15/262
1,839,748 A 1/1932 Evans
2,061,556 A 11/1936 Blake et al.
3,987,513 A 10/1976 Gonzales
4,252,097 A 2/1981 Hartford et al.
4,704,763 A * 11/1987 Sacks et al. ..... 15/262
6,158,258 A 12/2000 Bowman

FOREIGN PATENT DOCUMENTS

DE 196 48 956 A1 6/1998
DE 100 65 369 A1 7/2002
EP 0797 948 A1 10/1997
EP 1 219 226 A1 7/2002

* cited by examiner

*Primary Examiner*—David Redding
(74) *Attorney, Agent, or Firm*—Laurence A. Greenberg; Werner H. Stemer; Ralph E. Locher

(57) ABSTRACT

A device for wringing moisture from a mop includes pressure elements between which a holder of the mop, together with a mop cover attached thereto, can be pressed. The mop cover projects beyond the holder, thereby forming a cushion at edges of the holder in order to prevent the holder from doing damage, for example to furniture. In order to be able to wring moisture in a defined manner from both the projecting edge of the mop cover as well as the portion thereof covered by the holder, the two interacting pressure elements form a gap having a height which decreases toward the edges. In particular, the height decreases in a gradual manner. The pressure elements are preferably rollers, several cylinder sections of which can have different diameters in order to be able to obtain gap sections of different heights.

21 Claims, 16 Drawing Sheets

DEVICE FOR WRINGING A MOP AND FLOOR CLEANING SYSTEM HAVING THE DEVICE

CROSS-REFERENCE TO RELATED APPLICATION

This is a continuing application, under 35 U.S.C. § 120, of copending International Application No. PCT/EP2003/013586, filed Dec. 2, 2003, which designated the United States; this application also claims the priority, under 35 U.S.C. § 119, of German Patent Applications 10 256 090.0, 10 256 091.9 and 10 256 089.7, all filed Dec. 2, 2002; the prior applications are herewith incorporated by reference in their entirety.

BACKGROUND OF THE INVENTION

Field of the Invention

The present invention relates to a device for wringing a mop. The device includes two pressure elements between which a mop cover can be compressed and wrung out. The invention also relates to a floor cleaning system having the device and a mop.

German Published, Non-Prosecuted Patent Application DE 100 65 369A1 discloses a device for moistening and wringing a mop with an absorbent mop cover. The device has a spray for wetting a mop cover and two rollers that drive a carrier plate in a rotation direction. The rollers are disposed in such a manner that the mop cover can be moved into the nip of the rollers, thus being wrung out in the process. The mop cover is attached on the lower side to a stiff, flat holder of the mop in such a way that the mop cover and the holder have the same outline. The resulting disadvantage of that configuration is that the mop hits obstructions with its stiff holder, and in doing so sometimes damages the object posing the obstruction. The disadvantage of using a mop with a projecting mop cover is that the projecting part of the mop cover cannot be wrung out since it is not covered by the holder and thus cannot be compressed by the rollers.

SUMMARY OF THE INVENTION

It is accordingly an object of the invention to provide a device for wringing a mop and a floor cleaning system having the device, which overcome the hereinafore-mentioned disadvantages of the heretofore-known devices of this general type and which can evenly wring out a mop with a projecting mop cover.

With the foregoing and other objects in view there is provided, in accordance with the invention, a device for wringing a mop having a flat holder and a mop cover to be fastened to a lower side of the holder for projecting over the holder. The device comprises a wringing apparatus having a first pressure element and a second pressure element, for compression of the holder together with the mop cover between the first and second pressure elements for wringing the mop cover. The first and second pressure elements define a gap having a decreasing height toward edges of the mop cover, during the compression.

Due to the gap between the pressure elements having a height that tapers toward the edges, it is possible to achieve an even surface pressure on the mop cover even in the case of mops in which the mop cover projects over the edges of the holder. This also includes cases in which the holder is constructed to be thinner toward its edges and/or cases in which the total thickness of the holder and the mop cover changes not erratically but continuously. Due to the variable height of the gap between the pressure elements, the wringing apparatus can be constructed in such a way that even the wiping covers of almost any mop structure can be wrung out evenly over its entire surface.

The wringing apparatus can wring out the mop cover over its entire surface in one step or in sections. For the purpose of wringing out the mop cover in one step, the pressure elements must be laid out in such a way that they completely cover the surface of the mop cover and thus can simultaneously compress the entire mop cover.

However, the mop cover is also advantageously wrung out in sections in such a way that the pressure elements can wring out only one section of the mop cover simultaneously. In this case, the mop cover and the pressure elements must be moved opposite to one another for the purpose of wringing out the mop cover completely. The pressure elements are advantageously disposed in a stationary position in the device and the holder with the mop cover is moved with respect to the pressure elements along a path of movement.

The pressure elements can be moved basically in the direction of the height of the gap between the pressure elements in order to wring out the mop cover. Furthermore, the pressure elements can be rollers on which the mop cover rolls. The advantage of this is that the wringing apparatus has only a small space requirement and the mop cover can be wrung out using less effort by simply rotating the rollers.

A drive can be used that works independently of the pressure elements for the purpose of compression, in order to drive the holder and the mop cover along the path of movement. If rollers are used for compressing the mop cover they can be driven in the rotation direction in order to move the holder with the mop cover.

In a preferred embodiment, one pressure element is advantageously in the form of a continuous roller and the other pressure element is opposite to the continuous pressure elements and has two parts and a gap. Thus, a mop that has a handle attached to the holder can be guided through the gap of the two-part pressure element. In this case, the mop cover is directed on the continuous roller and the holder on the two-part roller located on the opposite side.

The height of the gap between the continuous and the multi-part roller can be reduced by providing a step and/or a ramp on one or both rollers. Advantageously, the continuous roller has a constant diameter and thus a straight surface line extending parallel to the axis. In contrast, the two parts of the multi-part roller have a shoulder and/or are each composed of at least two cylinder sections with varying diameters. Each part of the multi-part roller has one cylinder section with a larger diameter that is disposed on the edge of the gap used for guiding the mop cover through the gap and to which at least one cylinder section having the smaller diameter is connected on the inner side. The part of the mop cover projecting over the holder is compressed between the cylinder sections having the larger diameter and the continuous roller.

The part of the mop cover that is covered by the holder is compressed together with the holder between the cylinder sections having the smaller diameter and the continuous roller.

In this configuration, the holder is guided in the axial direction of the rollers between the front sides of the cylinder sections having the larger diameter of both of the parts of the two-part roller. In order to prevent the holder from deviating from this set position accidentally and being pulled between a cylinder section having the larger diameter and the continuous roller, a guide can be provided for the holder. This guide is aligned in such a manner that while inserting the holder, it allows the holder to remain in the axial direction of the rollers between the cylinder sections having the larger diameter. Moreover, the transitions between the cylinder sections having the larger diameter and the adjoining cylinder sections having smaller diameter can be beveled so that the holder is deflected into the interspace between the cylinder sections having the larger diameter in case of an eccentric insertion. In addition, the holder on the side disposed in the front in the movement direction can be narrower in the direction parallel to the rotation axis of the rollers in order to promote a centering of the holder during the insertion.

The continuous roller and/or the multi-part roller can be provided with an elastic covering that can adjust unevenness and can contribute to an even surface pressure. In addition, in the case of a driven roller, a covering of such a type can have a high friction coefficient in order to be able to take along the holder and/or the mop cover in the drive direction with better efficiency.

In particular, the continuous roller can be driven for the purpose of driving the holder in the movement direction, whereas the multi-part roller is mounted such that it can rotate freely. Additionally, the continuous roller can have an elastic covering with a high friction coefficient in order to drive the mop cover with improved efficiency, adjust unevenness of the mop cover and apply an even surface pressure.

According to an advantageous embodiment, the device additionally has a moistening device for moistening the mop cover. The mop cover is moistened before the wringing process so as to rinse dirt particles from the mop cover and to subsequently bring the quantity of residual liquid in the mop cover to a defined level.

With the objects of the invention in view, there is also provided a floor cleaning system. The system comprises a device according to the invention and a mop with a flat holder and a mop cover to be fastened to a lower side of the holder.

Other features which are considered as characteristic for the invention are set forth in the appended claims.

Although the invention is illustrated and described herein as embodied in a device for wringing a mop and a floor cleaning system having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
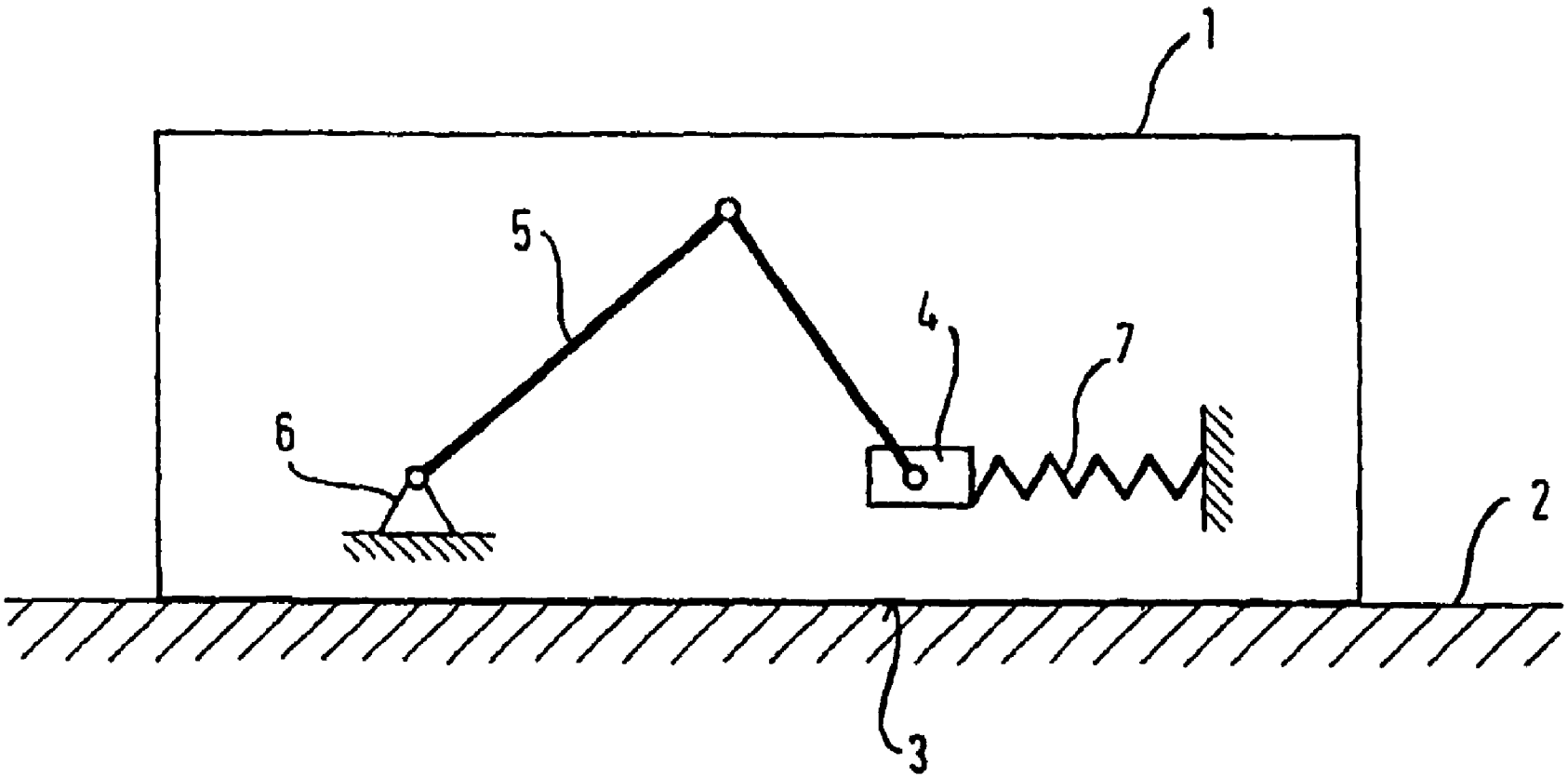
FIG. 1 is a highly diagrammatic, elevational view illustrating the principle of an inertia drive according to the invention.

Referring now to the figures of the drawings in detail and first, particularly, to FIG. 1 thereof, there is seen a highly diagrammatic illustration of the principle of an inertia, flywheel, centrifugal or gyrating drive according to the invention. In FIG. 1 a wiping device for moist wiping and thus cleaning of floors in a household or in other inside rooms is designated with reference numeral 1. The wiping device 1 is illustrated in FIG. 1 as having a base in the from of a simple box. The wiping device 1 lies on a floor 2 and faces the latter with a wiping surface 3.

An inertia or centrifugal mass 4, which is provided in the wiping device 1 and is only symbolically illustrated in this case, is disposed in such a way as to be movable and horizontal in a manner that is not illustrated in greater detail. In the present case, as is likewise only symbolically illustrated, the inertia or gyrating mass 4 is powered by a lever system 5 from a drive motor 6 and against the force of a spring 7. The drive motor 6 thus tensions the spring 7 to the right to a certain point, whereupon a release mechanism decouples the inertia or flywheel mass 4 from the force of the drive motor or releases the drive motor 6. At this point the spring 7 can accelerate the inertial mass 4 relatively quickly and to the left in FIG. 1. During this acceleration phase, a reaction force results on the base, i.e. the remainder of the wiping device 1, which accelerates the wiping device 1 to the right against static friction between the wiping surface 3 and the floor 2, as seen in FIG. 1.

Due to the sliding friction between the wiping surface 3 and the floor 2, this movement is braked again after a certain glide path. The spring 7 has in the meantime further pushed the inertial mass 4 away, so that the drive motor 6 can move the inertial mass 4 to the right again through the lever system 5 to tension the spring 7. At the same time this results in such little acceleration of the inertial mass 4 to the right that tensioning of the spring 7 does not lead to complementary jerky movement of the wiping device 1 to the left. With iterative repetition of the above-described procedure, the wiping device 1 therefore skids to the right step-by-step between the wiping surface 3 and the floor 2 as the static friction is overcome. This accordingly explains the basic principle of the inertia drive, and in particular with respect to a linear movement of the inertial mass 4 according to a model example.

Alternatively, the movement of the inertial mass 4 could be used by the drive motor 6 as an inertial mass movement for the movement phase. The wiping device 1 would then therefore be moved step-by-step to the left. The spring 7 would be utilized in that case only as an energy storage device to return the inertial mass 4 to the starting position for renewed acceleration by the drive motor 6. The spring 7 represents energy storage of any type, which could also be electric (capacitors), for example. It should be noted that the energy for returning the movement does not necessarily have to originate from the drive motor 6.

Figure 2:
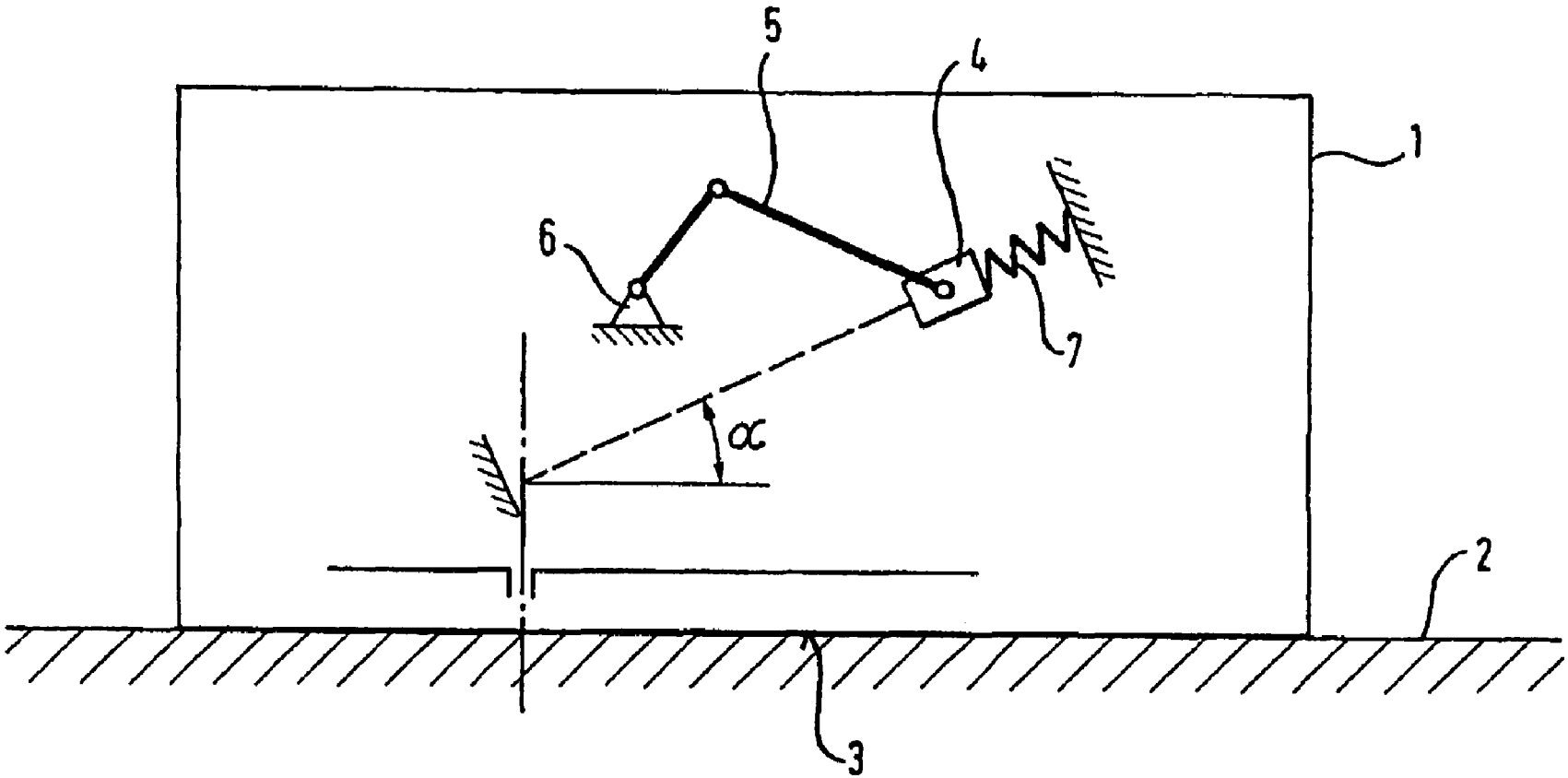
FIG. 2 is a view similar to FIG. 1 illustrating the principle of a variant of the device of FIG. 1.

FIG. 2 shows a very similar model, in which the same reference numerals are used as in FIG. 1. The difference between the mechanics illustrated in FIG. 2 and those in FIG. 1 is in a tilting of the movement path of the inertial mass 4 relative to the horizontal about an angle $\alpha$. The result thereof is that during acceleration of the inertial mass 4 by the spring 7, a reaction force or a recoil power acts on the wiping device 1, and this force is likewise tilted about the angle $\alpha$ relative to the horizontal. It therefore has a component acting against gravitational force. Therefore, not only a horizontal impulse directed to the right but also an impulse directed vertically upwards, act on the center of gravity of the wiping device 1. In concrete terms, the wiping device 1 becomes lighter in this movement phase, i.e. the resulting force effective for the friction between the wiping surface 3 and the floor 2 lessens. In this case, it should be pointed out that due to the layout of the inertia drive, influence can be made not only by intermittently greater and lesser deceleration and acceleration, but also through the direction thereof as to when the static friction is overcome and when it is not.

A further alternative to the functions illustrated by way of FIGS. 1 and 2 is to have the inertial mass 4 and the spring 7 describe self-oscillation as in a linear oscillator through the use of the drive motor 6, and preferably in a state close to resonance. In the variant of FIG. 2 which is inclined about the angle $\alpha$, the desired adhesion phases and slide movement phases consequently result in a different influence on the static friction at the two return points of this oscillation. In the variant of FIG. 1, the inertial mass 4 could, for example, be braked relatively hard at one of the two return points, for example by a non-illustrated elastic wall or another comparatively harder spring. This would then result in correspondingly large deceleration forces, with which the static friction can be overcome.

Figure 3:
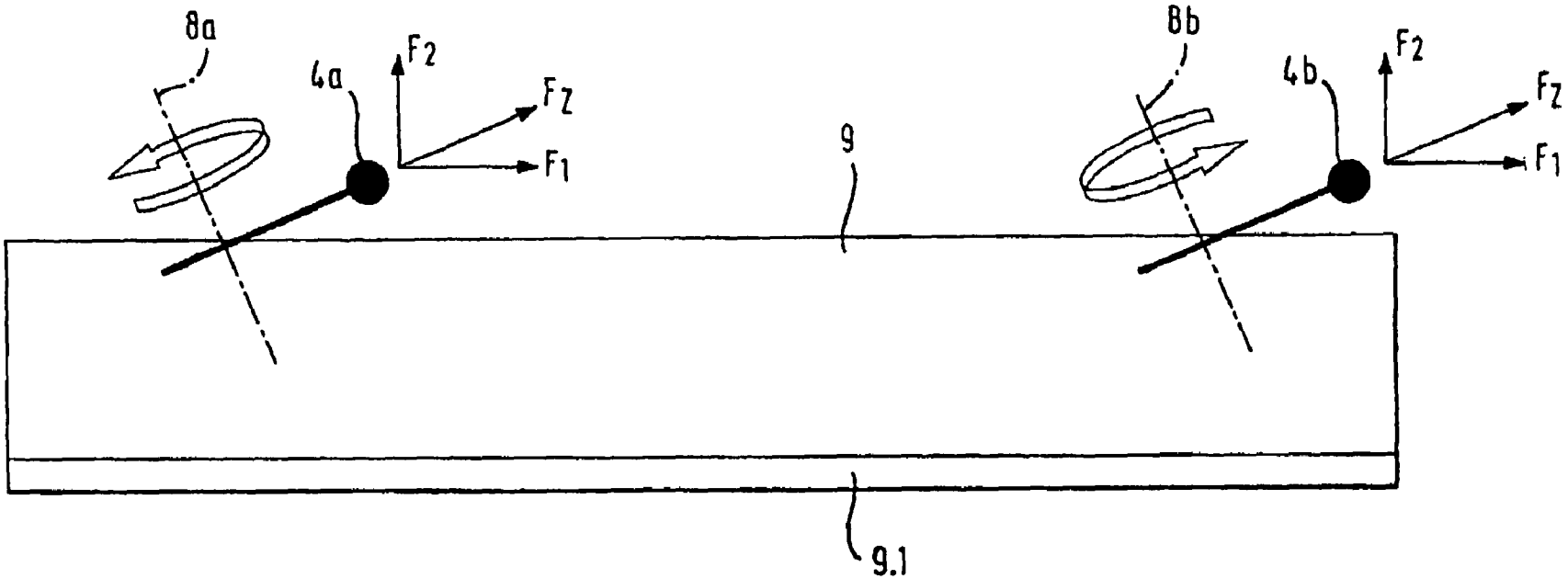
FIG. 3 is an elevational view of a wiping device according to the invention with an alternative inertia drive.

FIG. 3 illustrates another embodiment of an inertia drive. In this case, two inertial masses 4*a* and 4*b* are provided and mounted eccentrically and pivoting. Reference numerals 8*a* and 8*b* designate axes of rotation of their rotary movement. At the same time both inertial masses 4*a* and 4*b* rotate synchronously and in opposite directions. It is evident that the rotation planes and the axes of rotation 8*a* and 8*b* are inclined. The synchronous rotary movements of the inertial masses 4*a* and 4*b* are in each case isochronous in the uppermost (shown in FIG. 3) and in each case the lowermost vertex. In the uppermost vertex the centrifugal forces are thus added to a gravitation-reducing vertical component and a horizontal component. The horizontal components are in each case designated by reference symbol $F_1$ and the vertical components are in each case designated by reference symbol $F_2$. The canted centrifugal force is designated by reference symbol $F_z$. The centrifugal force can thus move the wiping device, which is designated herein by reference numeral 9 and has a base, by a specific slide path to the right. The wiping device 9 is provided with a wiping surface 9.1. In the lowest vertex of the rotation paths of the inertial masses 4*a* and 4*b* in each case the centrifugal forces are also added, however in this case they reinforce the essential force of the wiping device 9 and the vertical component of centrifugal force with respect to the static friction force resulting from gravity. The inertial forces are compensated at least partially in the remaining area of the respective paths through opposite rotation of the two inertial masses 4*a* and 4*b*, so that the static friction likewise is not exceeded there. The slide phase relates rather only to a specific temporal environment of the state in FIG. 3. Appropriate construction, i.e. matching between the friction coefficients, the masses, radii and speeds as well as path tilting angles of the inertial masses 4*a* and 4*b*, can result in the wiping device 9 lying straight in these deepest vertices as a result of static friction. In this embodiment the iterative glide phases can therefore be achieved by continuous circular movement of the inertial masses.

Figure 4:
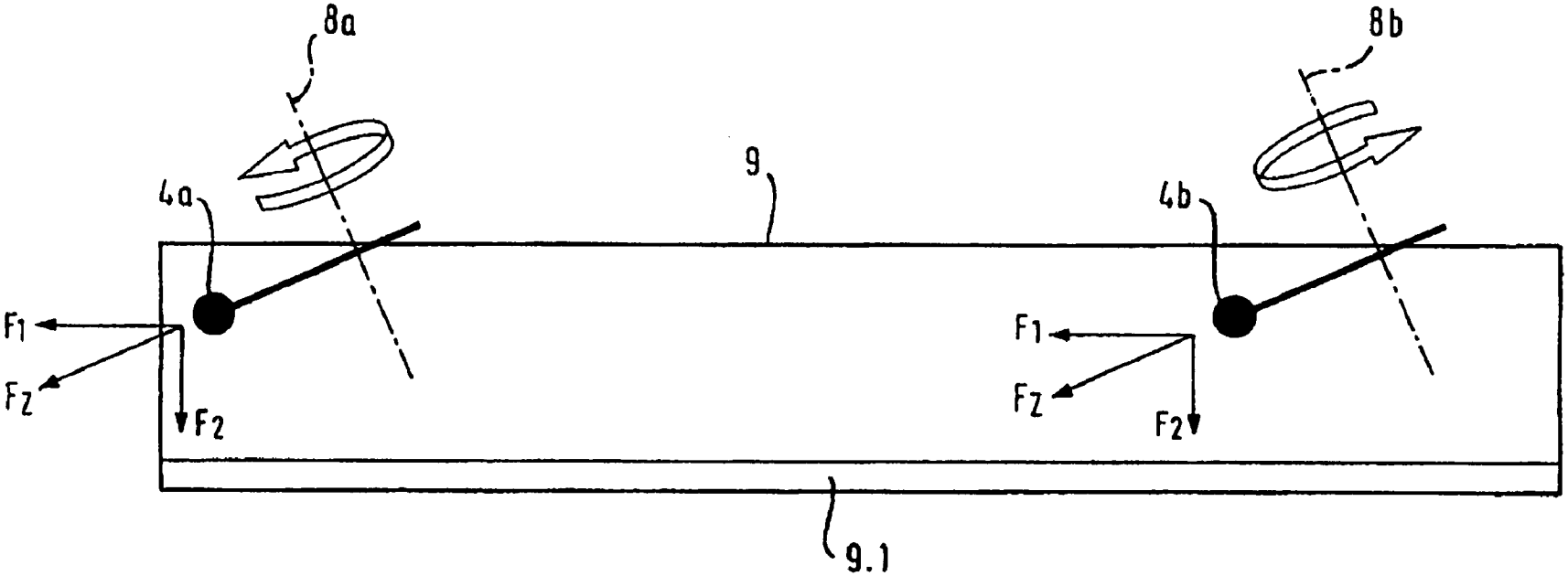
FIG. 4 shows the wiping device of FIG. 3 in another state of movement.

FIG. 4 shows the idle phase. In this case, the inertial masses are in each case in the deepest vertex of the respective circular movement.

Figure 5:
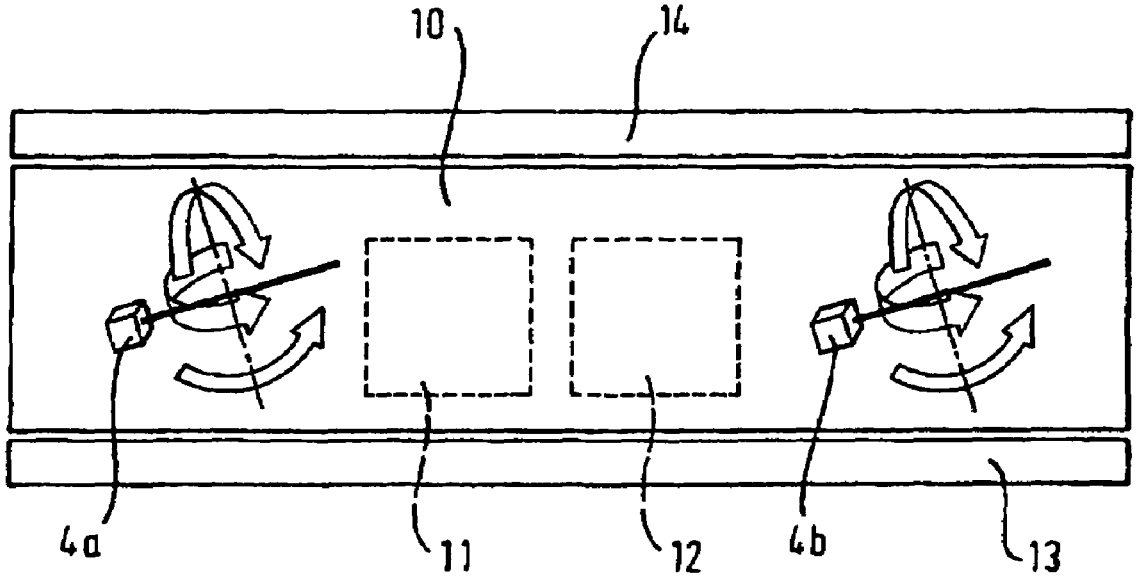
FIG. 5 shows an alternative to the wiping device of FIGS. 3 and 4.

FIG. 5 shows yet another wiping device 10 with a base and an inertia drive, which is only symbolically illustrated in this case and which corresponds to the description given for FIGS. 3 and 4. An electronic control 11 with a microprocessor for programming the wiping device, a storage device, an assessment device for position and acceleration sensors or for collision sensors, disposed on side edges of the wiping device 10, although not illustrated, as well as electronics for monitoring power electronics, which are designated by reference numeral 12 and controlling charging and discharging procedures of electrical storage batteries and a motor drive of the inertial masses 4*a* and 4*b*, are also symbolically illustrated. One of skill in the art is fully familiar with the electrotechnical details of such a control.

In the illustrated state, the wiping device 10 of FIG. 5 furthermore not only has on its underside a wiping cloth 13 with an underside which forms a temporarily used wiping surface, but on its upper side it has a further unused wiping cloth 14. The wiping cloth of the wiping device 10 can therefore either be reversed by the user by hand, or by a base station described in detail below, to be able to wipe further with the second wiping cloth 14, if the first wiping cloth 13 is soiled or worn. The wiping device illustrated in this case has a numerical ratio at the edges in projection on the floor of approximately over 3:1. This allows narrow interstices to be thoroughly cleaned on one hand, and achieves effective web widths on large surfaces on the other hand.

Figure 6:
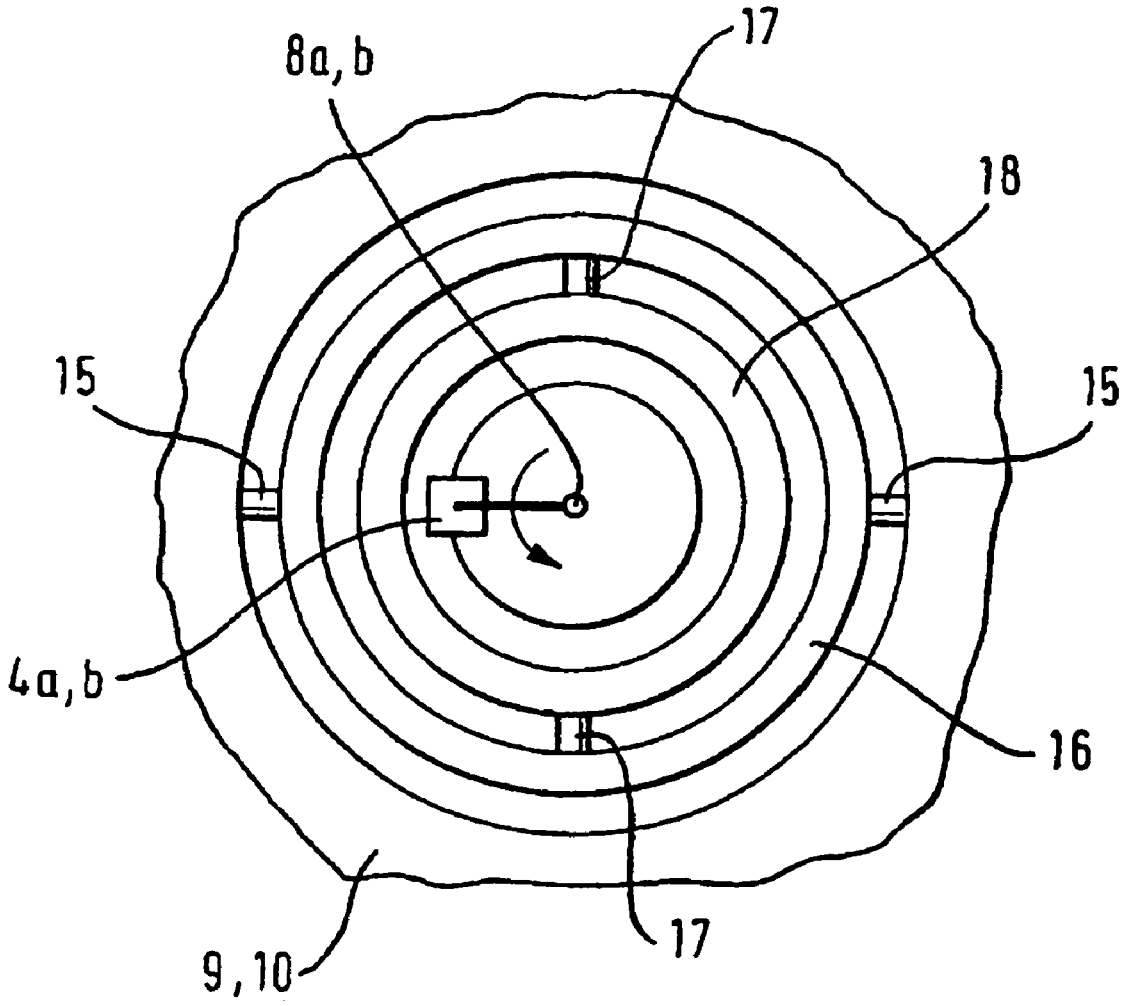
FIG. 6 is a fragmentary, top-plan view of a portion of FIGS. 3, 4 and 5.

FIG. 6 is a plan view which illustrates a cardanic configuration of the inertial masses 4*a* and 4*b* of FIGS. 3 to 5. A "fixed" base of the corresponding wiping device is shown.

The direction of sight is from above onto the floor plane. A first rotating shaft 15 holds a first cardanic ring 16, on which a second rotating shaft 17 is applied, which is shifted relative to the first rotating shaft 15 by 90°. The second rotating shaft 17 holds a second cardanic ring 18, on which the respective inertial mass 4*a* or 4*b* is pivotally mounted about the axis of rotation 8*a* to 8*b*. The motor drive unit of the respective inertial mass 4*a* or 4*b* is preferably provided by electromotors provided in the cardan bearings or through flexible shafts, which are advanced by motors attached solidly to the base 9, 10, but which are not illustrated. The cardanic configuration with the shafts 15 and 17 can likewise be adjusted by (non-illustrated) servomotors through a lever system with levers set on the rings 16, 18 on the respective rotating shaft 15 or 17.

It follows along with the description of FIGS. 3 to 5 given above, that the wiping device 9, 10 can adapt to different friction ratios between respective wiping cloths or other wiping surfaces and different floors, even when these are dependent on direction, by adjusting the rotation speeds and the rotation planes. In particular, the electronic control 11 can detect. when the wiping device 9, 10 is moved and for example through increasing tilting of the rotation planes can strive for a state in which the static friction is overcome phasewise but still prevails phasewise. In addition, the wiping device 9 and 10 can be moved in any horizontal direction as a result of the cardanic bearing configuration. It can easily also be imagined that turning the wiping device 9, 10 about a vertical axis can be attained by separate control of the rotation planes and/or the rotation phases of the two inertial masses 4*a* and 4*b*, in that the centrifugal force of the inertial masses is reversed at a maximal gravitation-reducing vertical component or superpositions with gravitation on both sides are different. Any superpositions from rotational movements and translatory movements can naturally also be achieved.

In order to provide an angular momentum drive, gyroscopes with a concentric center of gravity would have to be envisaged in FIG. 3 and in the following figures instead of the eccentrically suspended inertial masses. Their angular momentum could lie, for example, substantially horizontally and could act, through jerky changes relative to the original position, as angular momentum acting on the base with a vertical direction. This vertical angular momentum could turn a part of the wiping device. If at the same time an angular momentum component with horizontal direction provides for weighting an end, this could serve as an axis of rotation for a swiveling movement of the wiping device. Thereafter a further step could be made with reverse direction and at the corresponding other end of the wiping device with weighting, also resulting in this case in an iterative progressive motion possibility.

The drives described are all disposed within and thus above the wiping surface.

Figure 7:
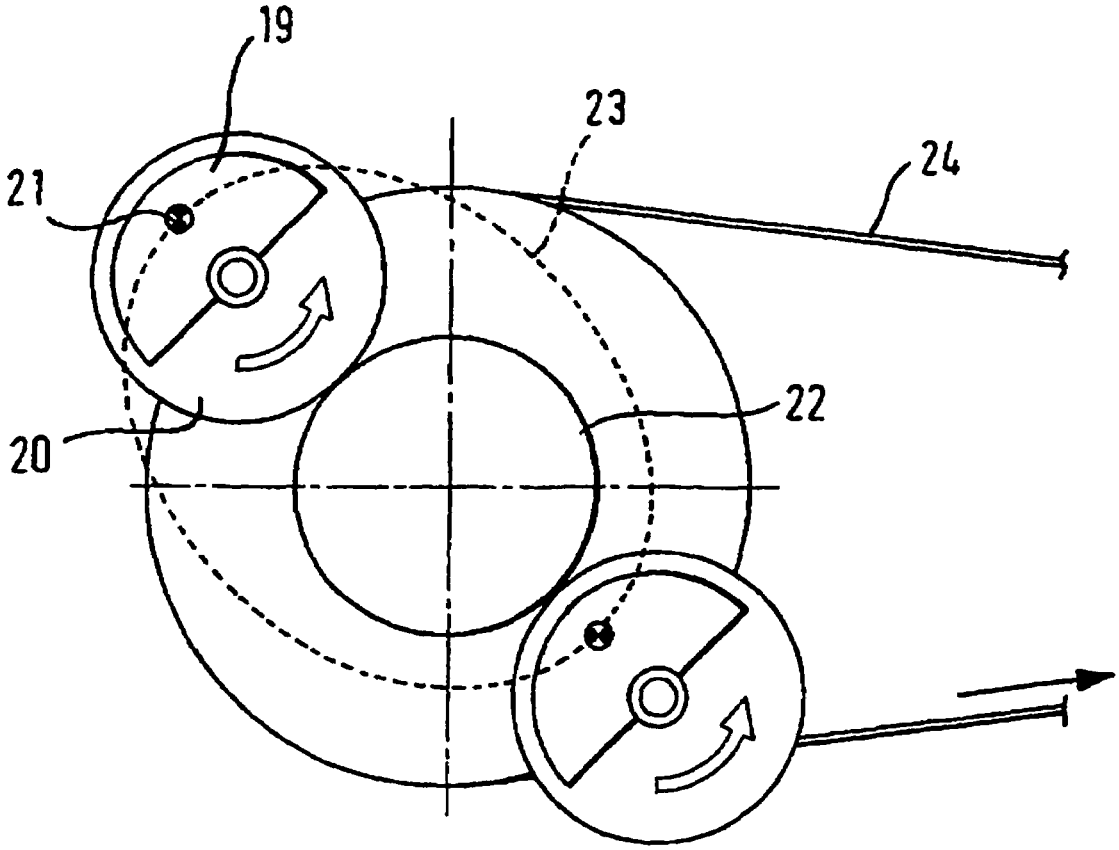
FIG. 7 is a diagrammatic illustration of a further alternative inertia drive.

FIG. 7 shows a further rotary movement of an inertial mass 19. The inertial mass 19 is connected eccentrically in a planet wheel 20, in which the center of gravity is designated by reference numeral 21. The planet wheel 20 runs on a fixed sun wheel 22. The middle point of the planet wheel describes a circular trajectory, however the center of gravity 21 describes an elliptical path 23 indicated in dashed lines. In the present case it can be envisaged that a rotating shaft of the planet wheel 20 is driven by a belt drive designated by reference numeral 24. FIG. 7 helps to clarify the fact that centrifugal force of varying magnitudes at different times can be achieved with the curve of the center of gravity of the inertial mass. Apart from this, the path speed itself of the inertial mass can naturally also be accelerated or decelerated in its path movement. In addition, the above-mentioned possibilities of mutual compensation of inertial forces of two or more inertial masses are taken into consideration.

As a result of aligning the longitudinal axis of the elliptical path in FIG. 7, this drive unit would already produce an inertial drive even without canting the path plane and with only one inertial mass 19.

Figure 8:
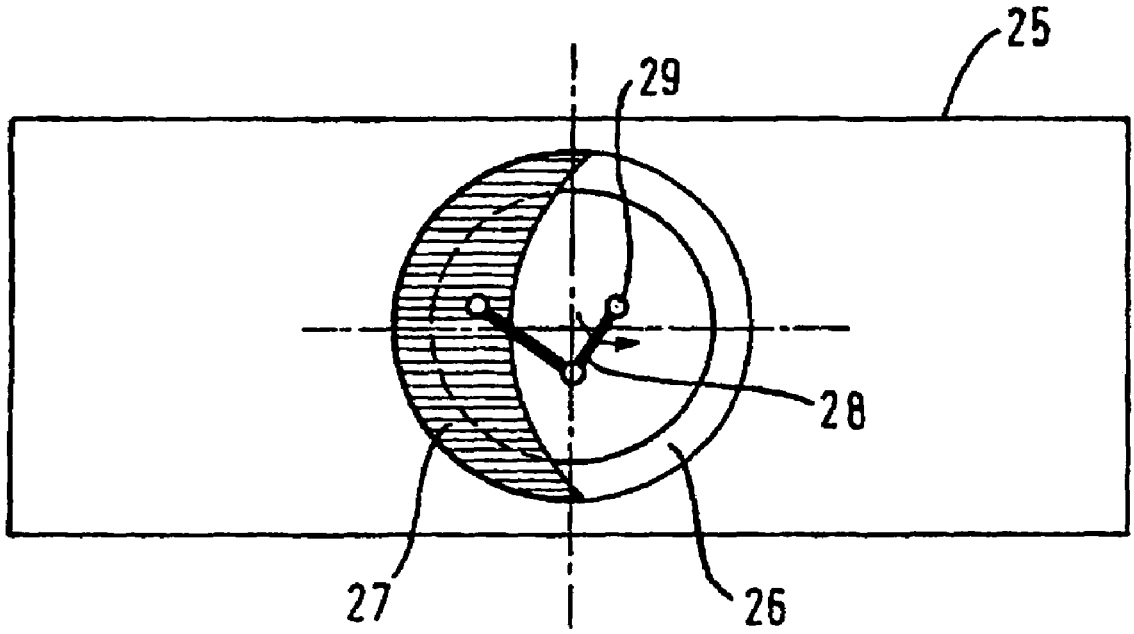
FIG. 8 is a plan view showing yet another diagrammatic illustration of an alternative inertia drive.

FIG. 8 shows a further example illustrating the principle of a possibility of an inertia drive. A wiping device shown in plan view is indicated diagrammatically by reference numeral 25. Within a bearing 26 provided in the wiping device 25 is an eccentric sickle-shaped inertial mass 27 that is guided for rotation. A movement of the inertial mass 27 can be achieved by a lever system (double crank with link) 28 through a motor connected at a point 29. This movement is uneven with uniform motor speed and correspondingly also leads to an inertial drive of the wiping device 25 with glide phases and adhesion phases.

Figure 9:
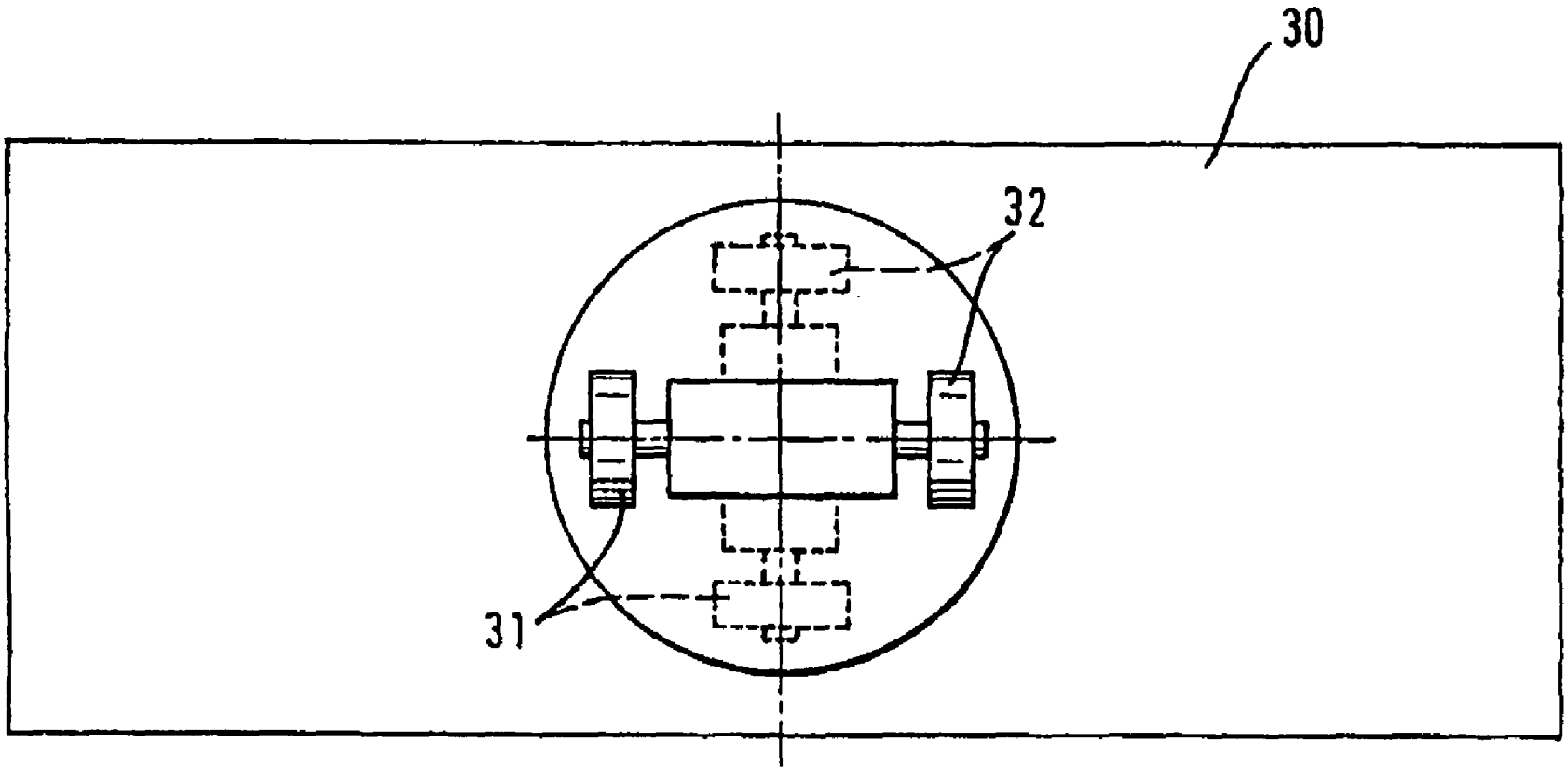
FIG. 9 is an elevational view of an example of a wheel drive.

FIG. 9 shows an alternative drive, which is not an inertia drive. In this case, a wheel drive which is provided inside a wiping device 30 is disposed inside the wiping surface (as is seen in the plan view of the wiping device 30 of FIG. 9), in which two wheels 31 and 32 can be driven independently of one another and can be turned relative to the wiping device 30. The wheels are shown in two different positions, however there are two wheels in all. The wiping device 30 with its wiping surface can thereby be transported across the floor, whereby any direction of movement as well as rotations of the wiping device 30 about its own axis can be achieved by way of differences in speed between the wheels 31 and 32 and by a motor adjustment of the angles of the axis of rotation of the wheels 31 and 32 relative to the wiping device 30. At the same time it must be ensured that a positive or force-locking between the wheels 31 and 32 and the floor is adequately high in relation to the slide friction of the wiping surface.

FIG. 9 shows in particular that with this drive unit a configuration inside the wiping surface is also possible and tracks appearing on the floor which are possibly caused by the wheels 31 and 32 can be wiped away later independently of the direction of movement. The wiping surface is namely a surface closed in around the drive unit.

In particular, in connection with the wheel drive, it can be provided for the wiping surface to oscillate relative to the rotation of the drive unit or in some other way, in order to heighten the mechanical cleaning action. An inertial mass can also be used for this purpose. In addition, the inertia drives can naturally be correspondingly supplemented in the different examples.

Figure 10:
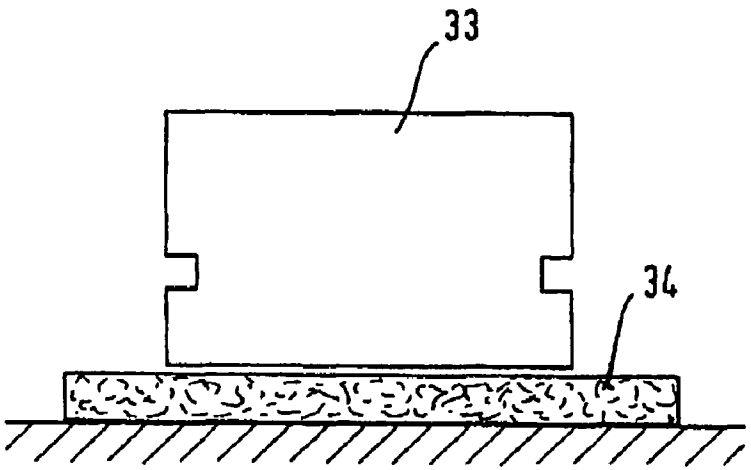
FIG. 10 is an exploded, front-elevational view of a wiping device.

FIG. 10 is a front view of a wiping device 33, which has a wiping cloth 34 projecting over the lateral edge of the actual wiping device 33. This wiping cloth 34 acts as an edge protection and also delimits the dimensions of the wiping device 33 in projection onto the floor. This allows, in particular, especially efficient wiping along wall edges, without the danger of damage as a result of an impact to the wiping device 33. The wiping devices can naturally and correspondingly also have impact protection edges independently of wiping cloths, which additionally can take on sensory tasks in order to inform the above-mentioned electronic control 11 of a collision with an obstacle.

Figure 11:
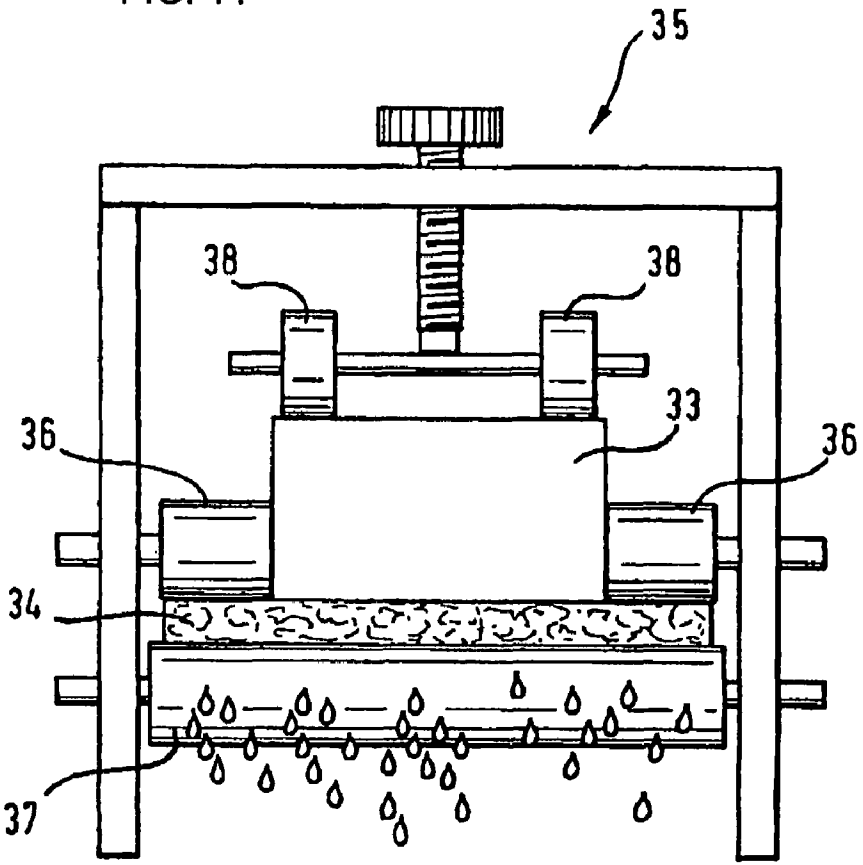
FIG. 11 is an elevational view illustrating the principle of a base station according to the invention.

FIG. 11 is a cross-sectional view taken along the line of sight of FIG. 10, illustrating the principle of a base station 35 for regenerating the wiping device 33. The wiping device 33 with the wiping cloth 34 is guided between squeezing rollers 36, 37, 38. The distance between the squeezing rollers 36 and 37 as well as between the squeezing rollers 38 and 37 is adjustable, so that the force, with which the wiping cloth 34 is squeezed out, can be determined in an appropriate manner. The squeezing rollers 38 press on the wiping device 33 itself and the squeezing rollers 36 press on the projecting edges of the wiping cloth 34, with the squeezing rollers 37 forming a counter bearing at the same time. The squeezed cleaning fluid flows away downwards as indicated.

Figure 12:
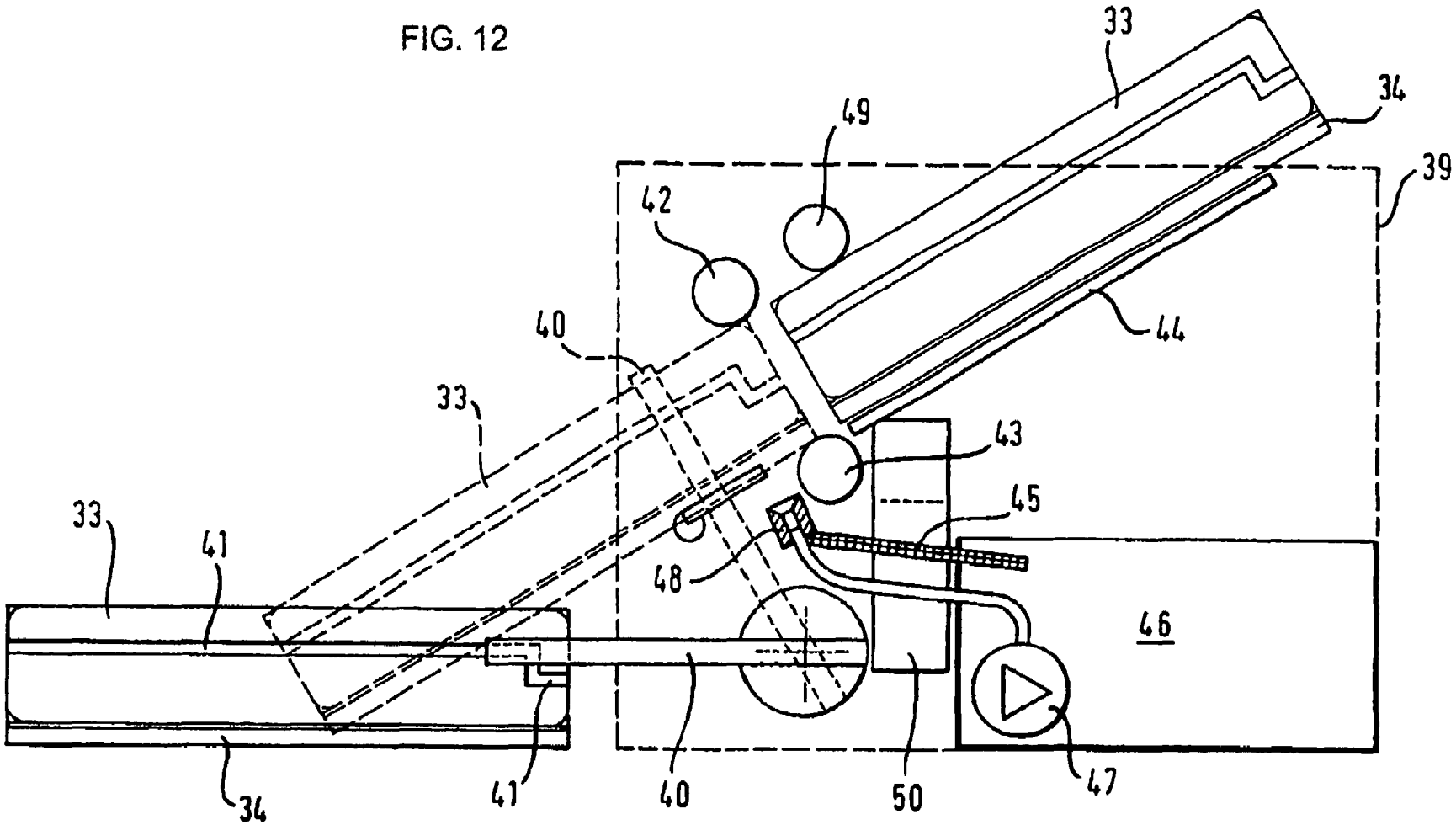
FIG. 12 is a more detailed side-elevational view of a base station according to the invention.

FIG. 12 shows a somewhat more concrete embodiment for the base station, which is designated herein by reference numeral 39. The wiping device 33 of FIG. 10 or, for example, the wiping device 10 of FIG. 5 or the wiping device 9 of FIG. 3, can be driven through the use of its own drive into a position illustrated to the left in FIG. 12. There they are gripped by two levers 40, which can be tilted by a motor as illustrated. At the same time spring-loaded pins, which are explained in greater detail below, are latched behind undercuts in grooves 41 seen in FIG. 12 in respective front regions of longitudinal sides of the wiping device 33. The lever 40 can thus grip the wiping device 33 and can lift and tilt it in the illustrated manner, so that the front end of the wiping device 33 is guided in between squeezing rollers 42 and 43. The squeezing rollers 42 and 43 draw the wiping device 33 further obliquely upwards, whereby the pilot pins unlatch from catches and instead run on in the grooves 41 as a guide. The wiping device 33 is transported in this way to an oblique plane 44, whereby the squeezing rollers 42 and 43 squeeze out any residual moisture remaining in the wiping cloth 34.

The draining cleaning fluid flows away through a continuous filter 45 into a waste-water reservoir 46, from which correspondingly cleaned cleaning fluid is supplied via the filter 45 through the use of a pump 47 to a nozzle 48, which then sprays the cleaning fluid to improve cleaning prior to squeezing out and/or when the wiping device 33 returns to the wiping cloth 34. The transport of the wiping device 33 is also supported by an additional transport roller 49. A fresh-water reservoir 50 which is also provided contains, for example, clear fresh water for subsequent wiping and for rinsing and accordingly can be attached to the nozzle 48 in a non-illustrated manner. The cleaning unit can carry out multiple, first wet and then dry wiping in the manner already described.

The oblique movement of the wiping device 33 on the plane 44 enables easy transport of the wiping device 33 through the use of the motor-driven lever 40 into the base station 39. The underside and thus the wiping cloth 34 of the wiping device 33 become accessible and space is made for the above components under the plane 44. A hydraulic unit on the continuous filter 45, the waste-water reservoir 46 and the nozzle 48 as well as the fresh-water reservoir 50 can be removed in their entirety as a module.

The distances between the rollers 42 and 49 relative to the roller 43 are also adjustable for ensuring optimal squeezing out and adequate positive or force-locking for transport. This means that the residual moisture in the cleaning cloth 34 can also be adjusted. The adjustment can be carried out, for example, by eccentric cams in rotating shaft bearings.

Figure 13:
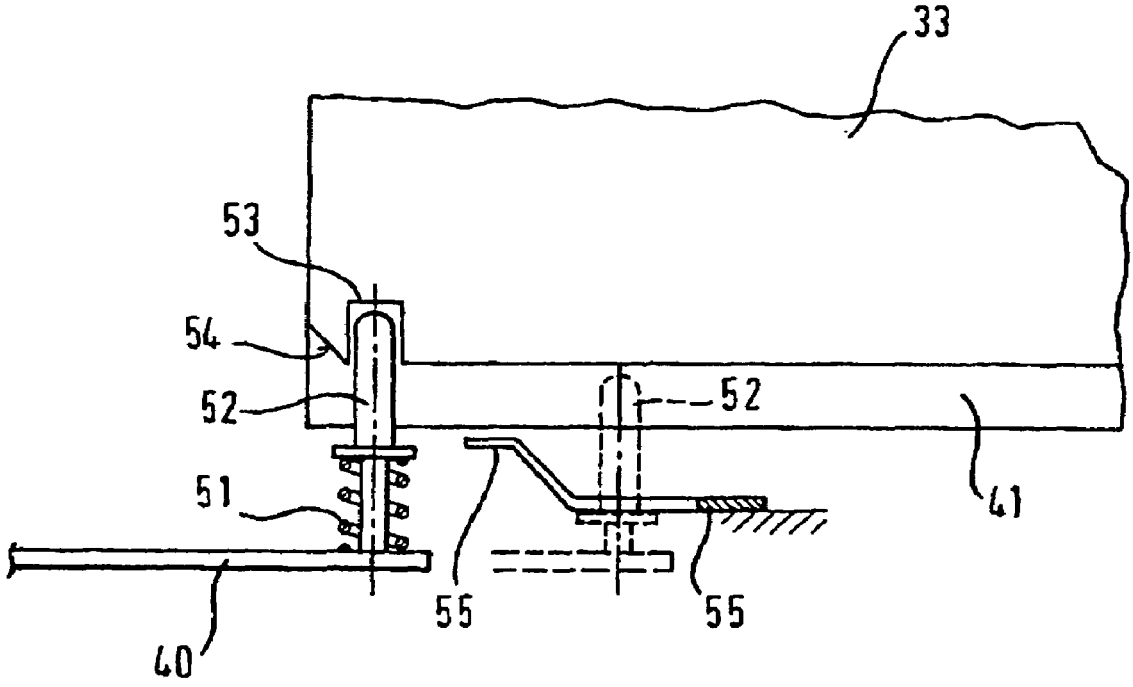
FIG. 13 is an enlarged, fragmentary view of a portion of FIG. 12.

FIG. 13 illustrates the above-mentioned latch mechanism for gripping the wiping device 33 by the lever 40. The end of one of the two levers 40, which is seen at the lower left, carries a pin 52 spring-loaded by a spring 51. It should be noted that FIG. 13 is laterally transposed as compared to FIG. 12.

Therefore, it is seen that in its initial region, in the vicinity of its right end in FIG. 12 and left end in FIG. 13, the above-mentioned groove 41 has an undercut 53, in which the pin 52 can latch. Locking in place is facilitated by a bevel 54 at the front of the groove 41. Unlocking from the undercut can occur either through a similar bevel through the use of the forces exerted by the squeezing rollers 42 and 43 or through the use of further mechanical uncoupling, which is indicated herein by a motor-driven fork 55. The fork can grasp the pin 52 and draw it out from the undercut 53. Thereafter the pin 52 glides along the groove 41 as a guide.

There are also other possibilities, of course, to transport the wiping device 33 motor-driven into a base station, possibly through portals, cranes, elevators, chain drives, pull ropes and the like. In particular, a base station can also be constructed to turn a wiping device with two wiping cloths (see FIG. 5) through 180°.

Figure 14:
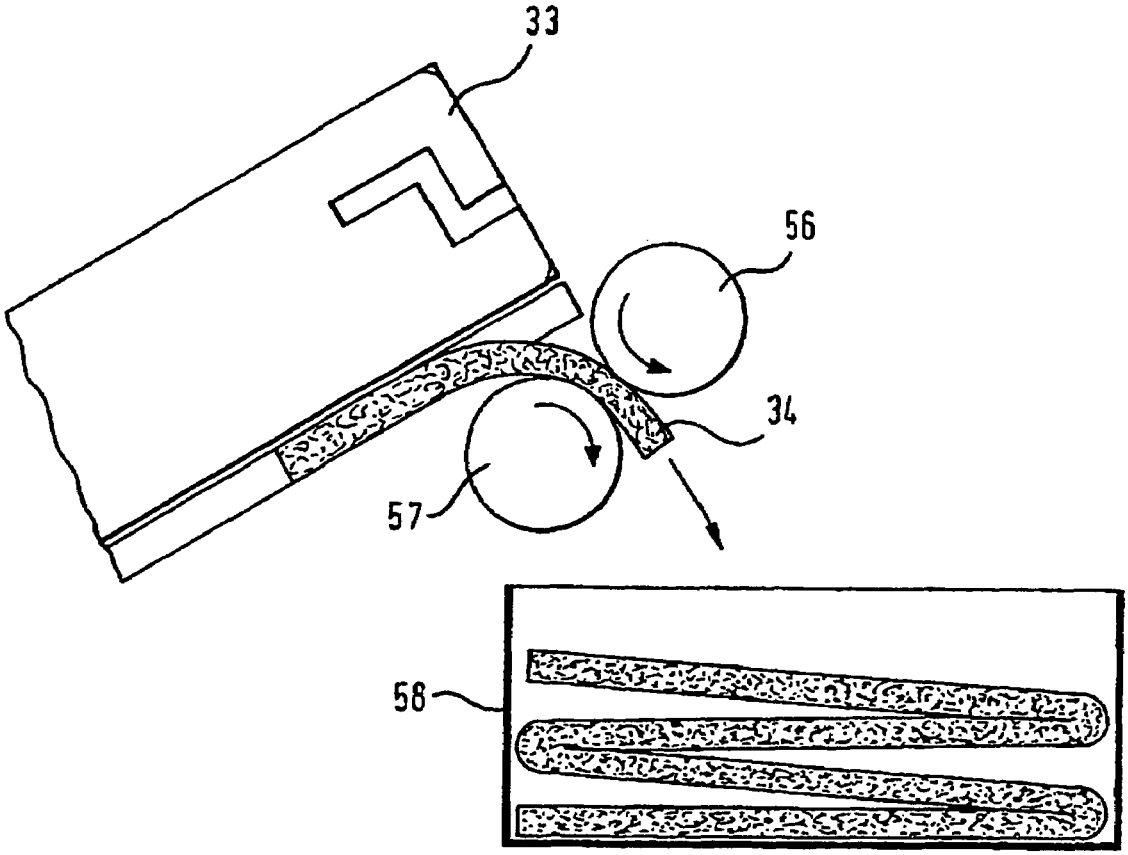
FIG. 14 is an elevational view showing further details of a base station according to the invention.
Figure 15:
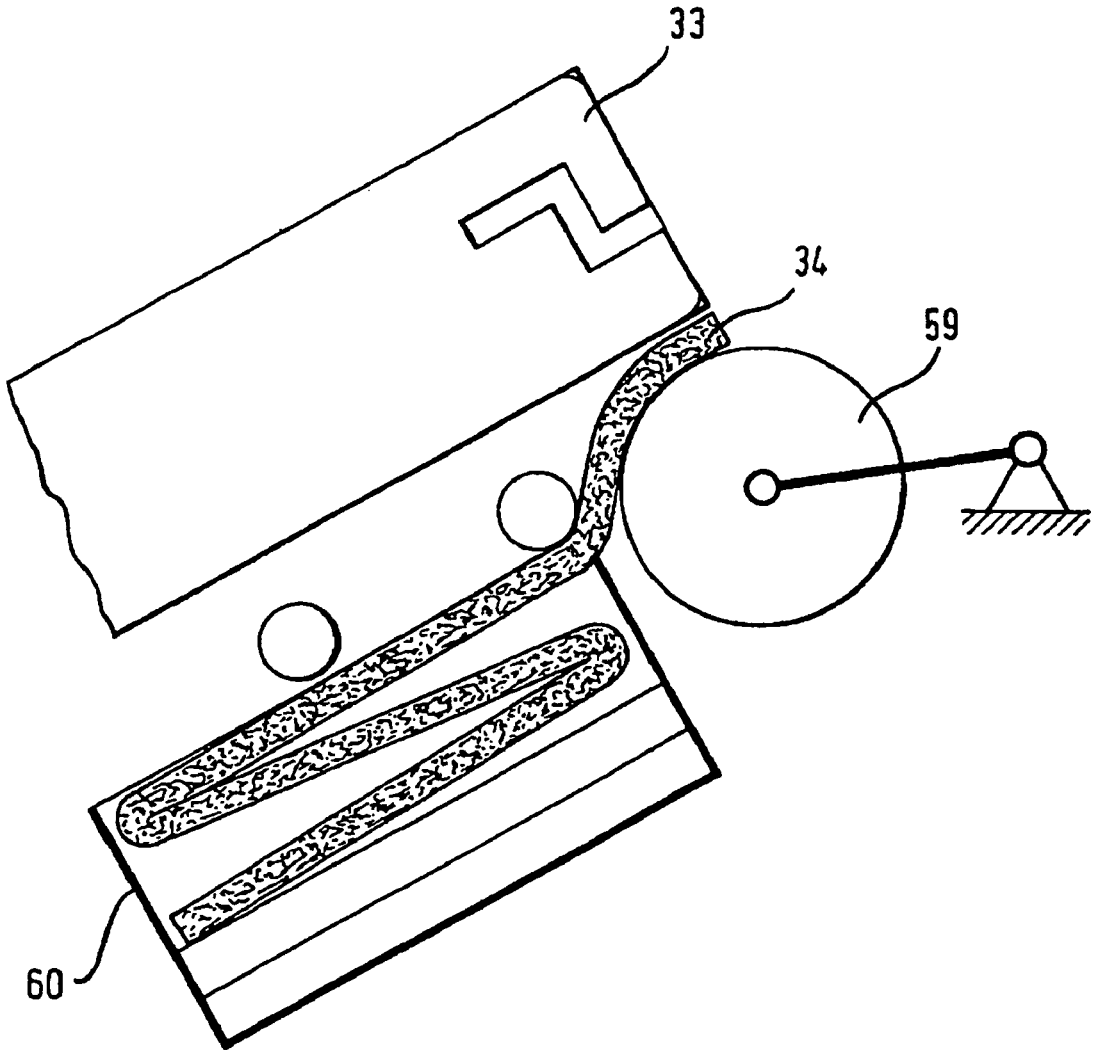
FIG. 15 is an elevational view showing additional details of a base station according to the invention.

FIG. 14 diagrammatically shows that in a second compartment the base station 39 can also serve for changing the wiping cloth 34. FIG. 14 shows how the wiping cloth 34 is pulled out by two rollers 56 and 57 from inclined closures (which are not illustrated in greater detail) on the lower face of the wiping device 33 and laid into a container 58. FIG. 15 shows, in reverse order, how the wiping cloth 34 or a fresh wiping cloth 34 can be removed by a press roller 59 from a container 60 and applied to an adhesive closure. With both procedures transport of the wiping device 33 comparable to the explanations regarding FIG. 12 takes place in an oblique direction. Lever mechanics corresponding to the explanations of FIG. 12 can also be employed.

The different motor-actuated movement steps in the base station 39 can be controlled by light barriers or similar sensors. As soon as the wiping device 33 is grasped, the typical current flows of the connected electromotors can also be utilized to draw conclusions about the respective movement phases.

Optical evaluations of the degree of contamination of the floor, of the wiping cloth, the cleaning fluid in the wiping cloth or in the container 46, of the degree of contamination of the filter 45 and similar factors, can be used, as already mentioned.

In addition to this, the base station 39 can be programmable for inputting specific residual moistures, cleaning cycles, wiping cloth data and the like. Wiping cloths may also contain transponders, which are read out into the base station.

The electronic control 11 of the wiping device, which can also be reprogrammed by electronic control of the base station, can control the wiping device (in whichever actual construction) under consideration of known data or data of room dimensions and floor characteristics gathered on earlier runs. The user can also specify the rooms to be cleaned and thus call up known data sets or respectively input essential features of such rooms. In addition, the wiping device can perform automatic positioning, by known odometric processes, in that the movement distances and directions are ascertained and thus the current positions are determined. Ascertaining position can naturally also occur by some other manner, for example by laser measuring systems.

The wiping runs are preferably S-shaped with a preferably identical forward-lying lengthways edge. In this way large surfaces can be cleaned with few runs and minimal overlapping of the acquired web widths. The above-described movement with a constant leading edge effectively prevents dirt streaks from being deposited in curves or corners.

A unit has a base station with a motor-driven transport device that is constructed for the purpose of transporting the mobile device for regeneration into and out of the base station.

The present description also refers particularly to a process for wiping floors. In the following description, however, the aspects of the device and the process are not differentiated from one another in detail so as to facilitate the understanding and intelligibility of the entire disclosure with respect to both categories.

The basic principle involves equipping the base station with a motorized device for the purpose of transporting the mobile device in and out although even the latter is motor-driven. In contrast to conventional units systems in which the mobile device moves with the help of its drive toward the base station and "parks," for instance, on or below corresponding connections for regeneration, the base station is provided with an independent motorized mechanism—the transport device. Using the transport device the mobile device can be brought into a definite position without requiring the mobile device to do so using its own drive. For instance, the transport device of the base station can also lift the mobile device, which the drive of the mobile device in many cases is incapable of doing. Incidentally, if desired or required, the transport device in the base station can apply relatively large forces, which the motorized drive of the mobile device that is provided, for instance, with an electric battery, etc. cannot apply or can apply only in case of a generous and hence unnecessary exertion of this drive.

The mobile device preferably has a wiping cloth with which it wipes the floor for cleaning or for other purposes. The regenerating process involves cleaning the wiping cloth or replacing the wiping cloth with a clean or a new wiping cloth. The term "wiping cloth" is to be understood as having a very general meaning here and can include all possible fiber-based flat products with which a floor can be wiped. Thus it can be non-woven materials, cloth, furry or papery textiles, etc.

The base station preferably contains a tilted plane on which the regeneration of the mobile device takes place and on which the transport device brings it for the purpose of regeneration. The tilted plane can ensure a better accessibility to the lower side of the mobile device and thus can facilitate the cleaning or replacing of a wiping cloth or any other type of regeneration.

The motor-driven transport device of the base station contains at least one, or preferably two, levers that are constructed for the purpose of grasping the mobile device. The grasped mobile device is then pulled into or lifted into the base station by the levers.

The lever or both of the levers are preferably provided with a mechanism that snaps into position on appropriately constructed grips of the mobile device if it is grasped by the levers. In doing so, the snap-fit connection should preferably by released again in the further course of the transport of the mobile device into the base station, wherein the levers can be used even after releasing the snap-fit connection to guide the transport device into the base station.

For instance, the snap-fit locking mechanism can be a spring-mounted pin coupler. The coupling pins can fit behind a corresponding grip and snap into position on an undercut. The coupling pins are preferably disposed on the levers and the grip with the undercut is preferably disposed on the mobile device. The spring-mounted coupling pins can be released from the snap-fit connection by an additional mechanical device in the base station or even by a tilted plane on the device of the base station with the undercut over which the pins can run up during the exertion of appropriately directed forces. Consequently, the pins can for instance extend along into a groove without an additional undercut in order to serve as a guide.

The base station cleans the mobile device preferably by guiding it through the use of a wringing roller that wrings out the cleaning liquid still contained in the wiping cloth or the cleaning liquid that is applied beforehand for cleaning the wiping cloth so as to remove the dirt attached to it. Similarly, this also applies to the process of wringing out the treatment liquids that are not used for cleaning purposes. The wringing roller is pressed preferably using adjustable pressure on the mobile device. The wringing roller can be mounted eccentrically or the guiding devices for the mobile device opposite to the wringing roller can be adjusted.

Furthermore, it is preferred to moisten the wiping cloth again after the wringing out process using a cleaning liquid or any other liquid. A preferred embodiment of the present invention uses a cleaning liquid that is recycled in the base station, and thus was already wrung out at a previous point in time. In this case, the base station can have a filter, particularly a continuous flow filter for the cleaning liquid.

The new moistening process can firstly be used to repeat and improve the cleaning process by a new wringing out process. Secondly it is preferable to moisten or to actually wet the wiping cloth slightly before a new wiping of the floor. It is particularly preferred if the cleaning system can also execute a second or a multi-level wiping process in that the mobile device first wet wipes or mops the floor and consequently absorbs the liquid still present on the floor by dry wiping or mopping it.

Apart from that, the base station can be provided with an additional device that enables the wiping cloth to be replaced by pulling it off from an adhesive fastener (so-called Velcro® fastener, or the like) on the mobile device. Subsequently, the process continues with a new and/or clean wiping cloth that is placed again on the adhesive fastener. In this embodiment, the base station is capable of performing this function automatically.

In the unit, the degree of soiling of the floor to be cleaned, the wiping cloth used, the cleaning liquid in the base station and/or the degree of soiling of the filter for the cleaning liquid can be measured and monitored, preferably using optical and/or opto-electronic measures.

The present invention also relates to a mobile device for wiping flat surfaces in which the drive is located within a path width covered by the wiping surface when the device moves using the drive.

Thus in this embodiment the drive is disposed within a path width covered by the wiping process. This particularly means that the drive does not interfere outside the path width covered in the wiping process if, for instance, a wiping action is necessary just alongside an edge of the floor. In this case, the invention enables the wiping surface to come within a relatively small distance to this edge or to wipe without any such distance because the drive, for instance a wheel running between the path width covered by the wiping process and the floor edge as a drive component, is disposed within the covered path width.

In doing so, the drive lies substantially above the surface to be wiped. The drive is disposed preferably over the wiping surface. In principle, however, it can be disposed in the movement direction in front of or behind the wiping surface as long as it remains within the path width.

Thus it is possible to provide a relatively broad wiping surface proportionate to the overall size of the device that is substantially also determined by the drive.

The wiping device preferably has narrow and long outer dimensions like a projection on the surface to be wiped, thus a clearly larger expansion in one direction than in a second direction extending vertically to the former. The numerical proportion of the dimensions of the longest and the narrowest side preferably amounts to at least 2:1, better at least 2.5:1 and in the most favorable case at least 3:1. A preferred basic shape of the projection of the device on the surface to be mopped is a narrow long rectangle. Narrow long outer dimensions enable a relatively large path width even in case of a device that is not too large. The device can particularly be inserted very flexibly while moving through narrow passages or while wiping small corners.

Moreover, it is preferred if the above-mentioned outer dimensions of the device are dependent on the surface to be wiped. Thus, the wiping surface at the level of the surface to be wiped forms the edges of the device or at least substantially corresponds to them. A replaceable wiping cover can be optionally disposed such that it projects on one or more sides over the remaining parts of the device. This configuration firstly enables particularly good wiping along floor edges and secondly forms a protective contact edge. Naturally, even additional contact edges can be provided that are not formed by the wiping surface itself. Contact edges that are equipped with sensory characteristics can also be provided in order to point out a collision with an obstacle to an automatic control of the device and thus to call forth corresponding control reactions.

The wiping device preferably moves forward during its operation in such a manner that during a wiping movement one and the same long side points to the front. Thus the wiping action proceeds firstly with the maximum path width possible and secondly the dirt scooped together during the cleaning process is shifted in front of the device. This preferably applies during and even after movements in corners around curves so that the wiping device does not leave behind any wiping streaks in corners or around curves. For instance, the wiping device can first move in a rectangular corner of a floor with the long side until the impact on the opposite edge, then move back, rotate by 90° in the sense of the future movement direction (so that the described long side now points toward the front in the future movement direction), move in this rotated position along the edge again into the corner in order to then move out of the corner and further in the new movement direction. In doing so, the wiping device moves into the corner with its long side lying in front, then out of the corner with the same long side lying in front and into the new movement direction.

Moreover, the wiping surface can be disposed such that it moves during its operation in an oscillating manner as opposed to the remaining part of the device. For instance, the wiping surface can swing or circle as opposed to the base of the device in one or in two (horizontal or vertical) directions. Thus, the mechanical action on the floor can be increased without having to cross the same path repeatedly.

In another embodiment of the invention the wiping device is equipped with a wiping surface not on one side but on two opposite sides. The device can then be turned automatically or manually by the intervention of an operator in order to be able to move further using the second wiping surface.

Incidentally, the wiping surface is preferably continuous, thus forming a contiguous surface in the mathematical sense. In addition, it is closed preferably in the movement direction behind the parts of the drive that touch the floor so that no traces are left by wheels, drive belts, etc. Such wheels or belts are thus preferably provided inside the wiping surface or in front of and/or a part of the wiping surface in the sense of the movement direction.

Moreover, an improved drive is provided for moving the device over a surface, including a motor-driven inertial mass that moves with respect to the base of the device and is constructed for the purpose of driving the device by moving the inertial mass with respect to the base. For this purpose, during a part of these movements the static friction holding the mop on the surface is overcome by mass inertia of the inertial mass and not during other parts, wherein the movements of the inertial mass are iterative with respect to the base.

In the inertial mass drive, mass inertial forces are utilized that result due to the relative movements between an inertial mass and a base forming the stationary part of the device to a certain extent. These mass inertial forces in specific phases result in overcoming the static friction that retains the device on the surface on which it is supposed to move. In other phases, however, the mass inertial forces do not overcome the static friction. The following description discusses movement phases and static phases for purposes of simplification. Depending on the frame, the movements of the inertial mass thus transfer inertial forces onto the base. These inertial forces partly move the base and partly let it adhere to the surface. In other words, the movements of the inertial mass lead to a reaction of the base since the complete system strives to correspond to the conservation of momentum. However, the conservation of momentum is disturbed by the friction between the device and the surface. In the static phases the base remains on the surface. In the movement phases it executes a preferably sliding or slipping movement on the surface. However, the base can also execute a rolling movement during the movement phases in the case of corresponding static friction in the static phases in wheel bearings or between wheel surfaces and the surface.

The fact that the movements of the inertial mass are iterative with respect to the base, hence repetitive and thus enabling a continued movement, creates a drive concept on the whole that requires no direct form-locking or force-locking connection between drive components and the surface on which the device is supposed to move.

In doing so, it is particularly possible for the device to contact the surface to be wiped exclusively with its wiping surface because no wheels, drive belt, etc. have to be used.

For purposes of clarification, it is pointed out herein that the inertial mass is a device component and is not supposed to be used by the drive concept. Indeed, an energy coupling will be required for generating this movement. However, the inertial mass is supposed to remain unchanged as such, as opposed to repulsion drives such as, for instance, rocket drives or jet drives.

Thus a sliding or rolling continuous movement is provided without coupling between the drive and the transport surface. This is preferable, for instance, if it is very difficult to create a form-locking connection or a force-locking connection with the transport surface, for instance on completely smooth surfaces, or if a contact between the drive and the surface is not desired.

There are various basic options for the type of movement between the inertial mass and the base. Firstly, linear movements are possible in which the inertial mass is moved to and fro iteratively. In doing so, appropriately strong accelerations or decelerations can generate inertial forces that lie over a threshold determined by the static friction. In the case of smaller accelerations and decelerations, the device remains within the static friction limits so that the inertial mass can be guided back for the benefit of a new movement phase of the device.

In this context, it is particularly preferable to provide, in addition to the actual motorized drive of the inertial mass, energy storage, particularly a mechanical spring that is loaded with energy and unloaded during the linear movements of the inertial mass synchronous to these movements. Due to this, firstly, at least parts of the energy spent by the motorized drive can be recovered. Secondly, the energy storage can use appropriately large forces to facilitate the acceleration phase provided for overcoming the static friction and the motorized drive itself can be used only for the purpose of return. Thus, the drive could press the inertial mass against the spring force and in doing so could stress the spring. Subsequently, the drive is switched off and the spring is able to accelerate the inertial mass with relatively large forces.

Furthermore, even rotary or preferably circular movements between the inertial mass and the base are possible. In the rotary movements and particularly during the circular movements, two cases are possible that could basically occur even in a combined form. Firstly, it is possible to utilize the actual conservation of momentum in the sense of the linear momentum, and thus within the meaning of the centrifugal forces. Secondly, however, even the conservation of angular momentum can be utilized in which the base experiences an angular momentum if the angular momentum of the inertial mass is changed. In the case of the conservation of linear momentum, the inertial mass is disposed eccentrically with respect to the rotary movement. In the case of the conservation of angular momentum, the inertial mass lies concentrically with respect to the rotary self-rotation. Here, in each case the term "inertial mass" refers to its center of gravity and not necessarily to its physical form. Thus in the first case, for instance, an increased acceleration of the inertial mass could be utilized in definite path regions, for instance in non-circular paths, such as sun wheel paths or planet wheel paths. In contrast, in the second case, for instance in the case of the change of direction of a concentric rotation of the inertial mass, the angular momentum acting on the base could be utilized. In both cases, to put it clearly, a "jerk" can be created on the base that overcomes the static friction for a definite movement phase.

It is preferred, though not urgently required, that the movement phases, i.e. the "jerky movements" of the base generated by the inertial mass are always in the same direction (including in the sense of rotary movements). In principle, cases are even possible in which the static friction even within the context of "return steps" is overcome, that altogether however lead to a smaller backward movement than the desired forward movement. Thus, for instance, the inertial mass drive could also briefly overcome the static friction limit in case of inertial forces that are basically taking effect in the wrong direction. Overcoming the static friction limit in the desired direction for a longer period of time or at a greater speed does not stand in the way of a continuous movement.

It is also particularly preferable to use components of the utilized inertial forces for the purpose of utilizing the static friction between the device and the surface on which it is supposed to move. Due to the corresponding layout of the movements, particularly their inclination, the device can become heavier or lighter from time to time and probably also in locations. To put it accurately, the device can be pressed by corresponding inertial forces on the surface or relieved of its gravitational force. Due to this, in addition to or as an alternative to the already mentioned use of particularly large inertial forces in certain movement phases, it is possible to differentiate between movement phases and static phases. For instance, inertial forces that remain constant in terms of value in the movement phases can lead to a sliding of the device due to the components opposite to the gravitational force and in static phases can lead to a state of static adhesion due to components acting parallel to the gravitational force.

The use of at least two inertial masses is also particularly preferred in the above context. In addition to the aforementioned aspects, this allows for a skilled combination of the respective inertial forces and phase-wise addition and/or compensation. For instance, two inertial masses that have moved in a circular manner and have eccentric centers of gravity can move in the opposite direction and synchronously so that their inertial forces become compensated twice during each complete rotation and add up twice during each complete rotation. Due to the additional tilting of the rotation planes in the phases of the addition, inertial force components can be created that are parallel to the gravitational force in one case and antiparallel to the gravitational force in the other case. As a result, the device moves only, or at least with stronger jerks, in the case last mentioned.

In the case of rotary components, the inertial masses are preferably cardanically-mounted on the base. This can serve for the tilting of the rotation planes in the context just described. Furthermore, the corresponding adjustment of the cardanic suspensions as opposed to a stationary unchanged tilting also results in an adjustment to the magnitude of the static friction between the device and the surface and in addition even a probably necessary compensation of direction dependencies of this static friction, for instance in case of aligned wiping cloths. The cardanic suspension can be adjusted preferably using motors and even automatically in such a way that the device tests the start of the movement phase to a certain extent and adjusts itself in case of given rotation movements by adjusting the tilting automatically to an optimum drive.

In the case of an inertial mass drive, by utilizing the conservation of linear momentum, thus also the centrifugal forces, the device moves preferably over the surface step by step with translatory individual steps in the case of targeted straight movements of the device. As opposed to that, in the utilization of the angular conservation of momentum, it is possible to utilize a conservation of angular momentum component acting on the base, in that one end of the device serves as the rotary shaft to a certain extent and is "weighed down" by an angular momentum conservation component that is parallel to the surface and is acting on the base. In the next step an opposite end of the device can be used as the rotary shaft and an angular momentum that acts in the opposite direction and on the base momentum conservation component can be used for a corresponding second step, i.e. a component vertical to the surface can be used for a corresponding second step. In this case the device would continue to move, for instance alternating a right and a left side step by step, and in doing so would turn around the other side in each case. The angular momentum components can be created either by tilting rotating gyroscopes or by accelerating or decelerating such gyroscopes. However, the latter option is less preferred.

Incidentally, the device does not have to be necessarily free from other drive or steering influences. For instance, in the case of the preferred use as a cleaning device the configuration can also enable an operator to influence the movement, for instance by attaching a handle for steering or supporting the movement. A motor-driven mobile device with a handle would firstly make it easier for cleaning personnel to push the mobile device over the surface to be cleaned and secondly the mobile device could be additionally much heavier and more capable of more efficient cleaning action than a conventional manually operated mobile device. However, an autarkic and automatically moving cleaning device with the described inertial mass drive is preferred.

Figure 16:
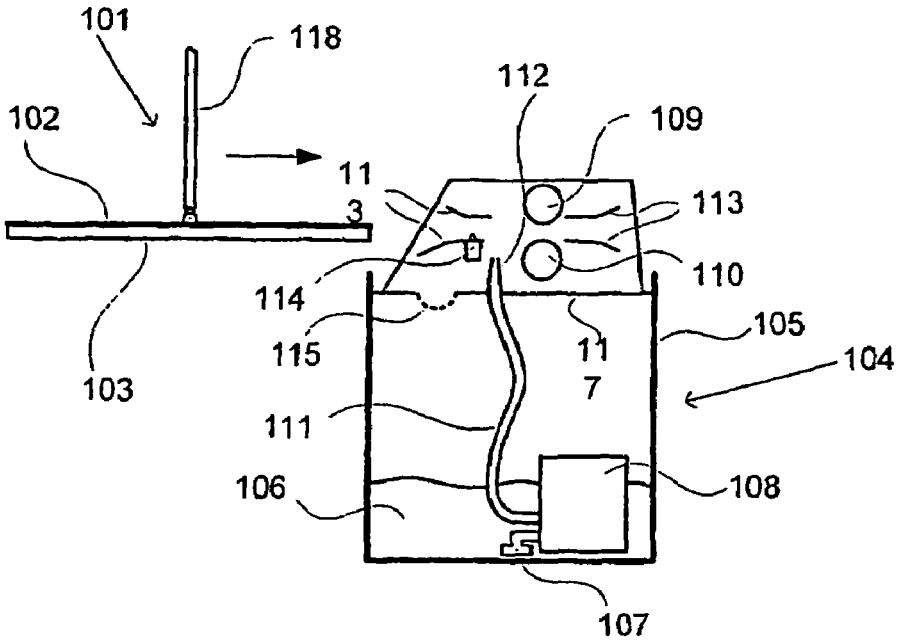
FIG. 16 is a side-elevational view of a device according to the invention for moistening a mop, together with a mop for usage with the device in accordance with another embodiment.

FIG. 16 diagrammatically illustrates a device 104 for moistening a wet wiping device, referred to below as a mop 101, which is operated manually. The mop 101 has a holder 102 attached to a handle 118 for holding a mop cover 103. The mop cover or blanket 103 is flexible and absorbent so that it can be moistened for the purpose of cleaning floors with a cleaning liquid.

For the purpose of moistening the mop cover, the mop 101 is guided in the direction of the arrow by the device 104 through a guide 113 that has individual guiding elements in the form of horizontally disposed metal sheets. The guide 113 guides the holder 102 horizontally along a movement path having a wetting device in the form of a nozzle 112. The nozzle 112 is connected through the use of a liquid line 111 to a pump 108 that is disposed on the bottom of a container 105 that forms the base of the device 104. The container 105 contains a cleaning liquid 106 that is sucked from the pump 108 using an inlet filter 107 and can be pumped by the line 111 to the nozzle 112. The nozzle 112 sprays the liquid 106 from below against the mop cover 103 of the mop 101.

A sensor 114, for instance in the form of a switch, is provided in the guide 113. The sensor records the presence of the holder 102 in the guide 113. As soon as the holder 102 is inserted into the guide 113 and this is recorded by the sensor 114, a non-illustrated control controls the pump 108 so that the nozzle 112 sprays the liquid 106 upward. At the same time a motor-driven drive roller 110 that is disposed below the movement path is activated. Two counter rollers 109 are disposed on the side of the movement path that lies opposite to the drive roller 110. The counter rollers are disposed coaxially to one another and can rotate around a rotary shaft that is parallel to the rotary shaft of the drive roller 110. The holder 102 can thus be pulled together with the mop cover 103 between the drive roller 110 and the counter rollers 109.

The distance between the drive roller 110 and the counter rollers 109 is dimensioned such that the holder 102 with the mop cover 103 forms a friction fit with the rollers 109, 110 so that it can be gripped and driven.

The drive roller 110 extends over the entire width of the mop cover 103, vertically to the drive direction, so that it rests against the mop cover 103 on the lower side, covering its entire width. The two counter rollers 109 are disposed over the edges of the holder 102 and the mop cover 103 in the extension of the width of the holder 102 and leave an open interspace between them. The interspace between the rollers 109 is used for guiding the handle 118 of the mop through the interspace.

Figure 17:
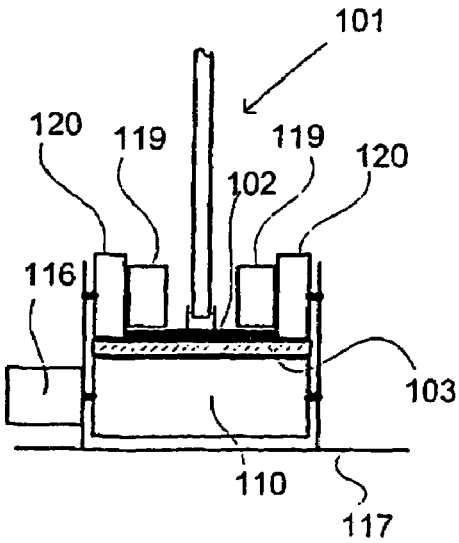
FIG. 17 is an enlarged, fragmentary, front-elevational view of the device in accordance with FIG. 16 together with the mop.

FIG. 17 illustrates a top part of the device 104, together with a lower part of the mop 101, from the front. As can be seen, each of the counter rollers 109 includes two cylinder sections 119, 120 that are disposed concentrically to one another and have different diameters. The smaller cylinder sections 119 are each disposed inwardly and the larger cylinder sections 120 are each disposed outwardly. As a result, a gap between the drive roller 110 and the larger cylinder sections 120 disposed outwardly is smaller than a gap between the drive roller 110 and the smaller cylinder sections 119. The drive roller 110 is connected additionally to a motor 116 for driving in the rotation direction.

Furthermore, FIG. 17 illustrates that the mop cover 103 is broader than the holder 102, in the movement direction, and projects over the sides of the holder 102. The edges of the mop cover 103, projecting on both sides, form a pad for the holder 102, protecting obstructing objects such as furniture from being damaged by the holder 102. Since the holder 102 must be able to transfer force for wringing out the mop cover 103, the holder 102 is preferably made of a stiff material such as, for instance, a metal. Consequently, the holder 102 could by all means damage other obstructing objects during contact. For this reason, the configuration of a projecting mop cover 103 as a protective element is particularly advantageous.

For the purpose of wringing out even the projecting parts of the mop cover 103, the smaller cylinder sections 119 disposed inwardly are dimensioned such that they can wring out the holder 102 together with the part of the mop cover 103 lying below it by pressing it on the drive roller 110. The larger cylinder sections 120 are dimensioned such that they can wring out the edges of the mop cover 103 projecting laterally over the holder 102 by pressing them on the drive roller 110. For this purpose, the height of the larger cylinder sections 120 in the axial direction is at least equal to the width of the projecting edge of the mop cover 103. Likewise, the diameter of the larger cylinder sections 120 together with the distance between the shafts for the counter rollers 109 and the drive roller 110, are selected such that the projecting edge of the mop cover 103 can be pressed between them.

The smaller cylinder sections 119 disposed inwardly are only required to bear on the holder 102 and press it against the drive roller 110 in order to wring out the part of the mop cover 103 covered by the holder 102. A recess and/or a gap is provided between the two smaller cylinder sections 119 for the purpose of guiding the handle 118 through the gap. The narrower the gap, the more difficult it is to guide the handle 118 therethrough. Conversely, a gap with increasing narrowness increases the surface with which the smaller cylinder sections 119 press on the holder 102. This results in reducing the bending moment acting on the holder 102.

The two adjoining cylinder sections 119, 120 are mounted coaxially relative to one another on a common shaft, whereby both cylinder sections 119, 120 can rotate independent of one another.

Figure 18:
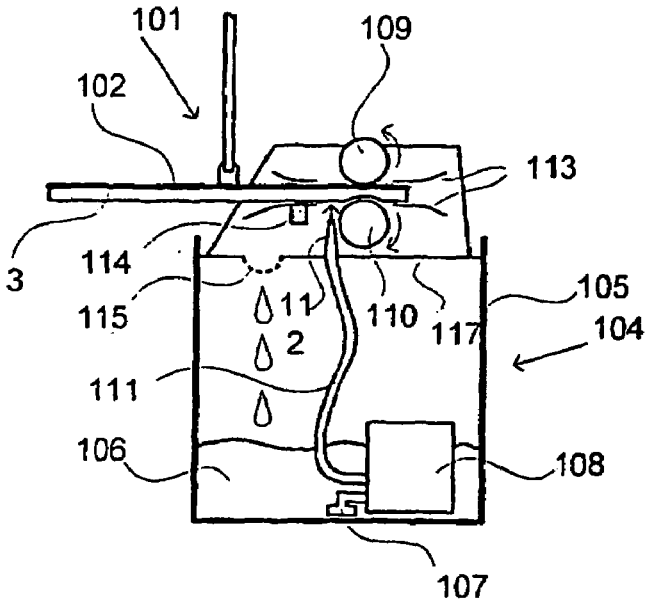
FIG. 18 is a side-elevational view of the device in accordance with FIG. 16 during operation of the device for moistening and wringing out the mop.

Due to the pressure of the drive roller 110, the mop cover 103 is dried in part and/or liquid is wrung out of the mop cover 103. The wrung out liquid 106 flows on an intermediate floor 117 and from there through a dirt filter 115 back into the container 105. In the process of guiding the mop 101 through the guide 113, which is illustrated in FIG. 18, the mop cover 103 is sprayed from below with the cleaning liquid 106 so that the mop cover 103 can be moistened and the dirt particles present in it can be rinsed out. The mop cover is subsequently dried in part so that it discharges a definite quantity of moisture on the right side of the device 104. As a result, the mop cover 103 does not drip while cleaning. The control also records when the holder 102 releases the sensor 114 and/or when the back end of the holder 102 has passed the sensor 114 and then controls the pump 108 and the drive roller 110 for a definite period of time until the holder 102 is completely pulled through the rollers 109, 110. The control process of the pump 108 can be ended even before the control process of the rollers 109, 110.

Figure 19:
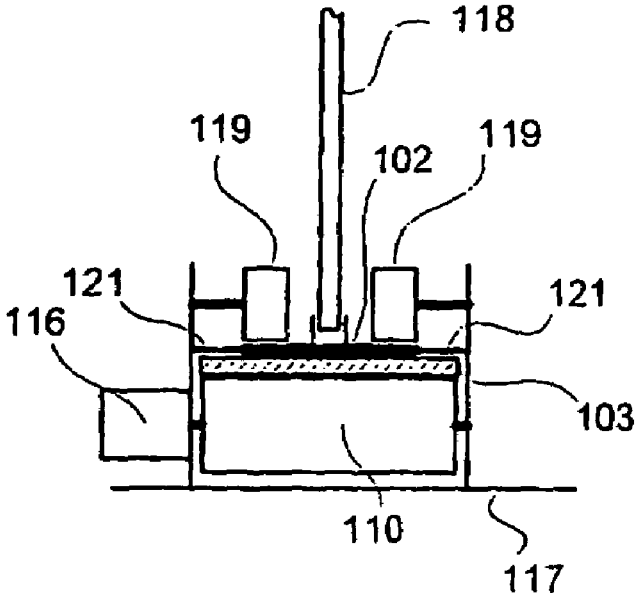
FIG. 19 is an enlarged, sectional, front-elevational view of the device and the mop in accordance with an additional embodiment of the present invention.

FIG. 19 illustrates a second embodiment in which the larger cylinder sections 120 are replaced by sliding surfaces 121 that are disposed outwardly next to the smaller cylinder sections 119 so as to lie over the edges of the mop cover 103 that project over the holder 102. The sliding surfaces 121 are disposed in such a manner that their distance from the drive roller 110 is less than the height of the mop cover 103 so as to compress the edges of the mop cover 103 when they are guided through for being wrung out. The ends of the sliding surfaces 121 on which the holder is inserted are bent upward so that the holder 102 and the mop cover 103 can be inserted easily.

Figure 20:
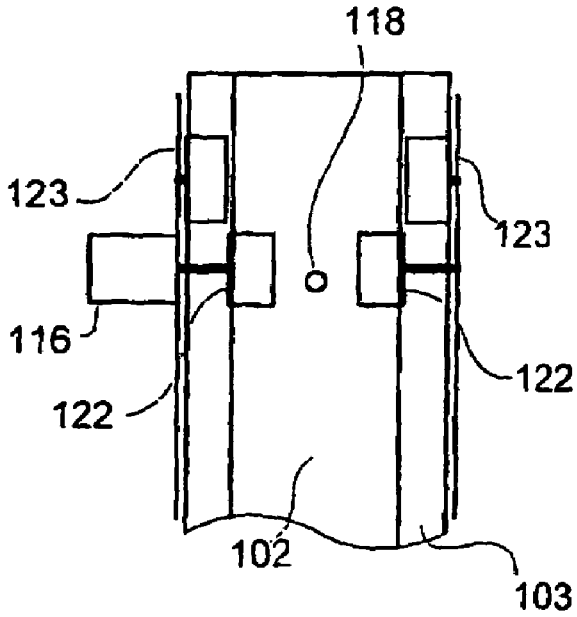
FIG. 20 is a fragmentary, top-plan view of a part of the device together with a mop, in accordance with another embodiment of the present invention.

FIG. 20 illustrates a third embodiment of the device according to the invention in which, just as in the first embodiment, an outer roller 123 is provided as a pressure element over each projecting edge of the mop cover 103. The outer rollers 123 correspond to the larger cylinder sections 120 of the first embodiment, with respect to their placement perpendicular to the movement direction of the holder 102. The outer rollers 123 are disposed behind the drive roller 110 in the movement direction. In order to be able to compress the edges of the mop cover 3, counter bearings are assigned to the outer rollers 123 below the mop cover 103. These counter bearings can be formed by rollers or sliding surfaces.

Inner rollers 122 are provided between the two outer rollers 123. Each of the inner rollers 122 is disposed in the same location as the smaller cylinder sections 119 in the first embodiment. In contrast to the first embodiment, the rollers that press on the holder 102 and/or the projecting edge of the mop cover 103 are not seated on a common shaft. The bending moment of the rollers can thus be distributed on two shafts.

The mop is constructed as a mobile device (such as the device 33 seen in FIGS. 10–12) with its own drive. The mop automatically starts up a device for regenerating the mop and the mop can be regenerated automatically.

The mobile device has a housing and a holder for the mop cover. A section of the holder projects over the housing and the mop cover 103 projects over the holder. The pressure element which is constructed as a cylinder section 119, 122 presses on the projecting holder section.

The diameter of the cylinder section 119, 122 that presses on the projecting holder section is smaller by twice the thickness of the holder than the cylinder section 120, 123 that presses on the mop cover 103 projecting over the holder.

A device, preferably a toothing, is provided between the cylinder section 119, 122 that presses on the holder section and the holder section, for creating a form-locking connection in order to ensure secure transportation.

The cylinder section 119, 122 and/or the cylinder section 120, 123, particularly the cylinder section 119, 122 that presses on the holder section, can be mounted independently of the other cylinder section 120, 123 and can be disposed such that it can be pretensioned flexibly in the direction of the holder section using a pretensioning device, preferably a spring. This is done in order to adjust the differences in the heights of the projecting mop cover and the projecting holder section.

We claim:

1. A device for wringing a mop having a flat holder and a mop cover to be fastened to a lower side of the holder for projecting over the holder, the device comprising:

a wringing apparatus having a first pressure element and a second pressure element disposed underneath said first pressure element, said pressure elements configured for providing compression of the holder together with the mop cover between said first and second pressure elements for wringing the mop cover; and said first and second pressure elements defining a gap having a decreasing height toward edges of the mop cover, during the compression.

2. The device according to claim 1, which further comprises a drive for moving the holder and the mop cover relative to said first and second pressure elements, along a movement path.

3. The device according to claim 2, wherein one of said pressure elements is a continuous pressure element extended over an entire width of the mop cover perpendicularly to said movement path, and the other of said pressure elements has two parts defining a gap therebetween extended perpendicular to said movement path.

4. The device according to claim 1, wherein at least one of said pressure elemehts has a step or a ramp for reducing a height of said gap between said pressure elements.

5. The device according to claim 1, wherein said pressure elements are selected from the group consisting of rotatable rollers and slide bearings.

6. The device according to claim 5, wherein at least one of said pressure elements has a plurality of roller sections disposed concentrically to one another.

7. The device according to claim 6, wherein said roller sections are rotatable independently of one another.

8. The device according to claim 1, wherein at least one of said pressure elements is a roller to be driven by a rotary drive in a rotation direction.

9. The device according to claim 1, wherein at least one of said pressure elements has an elastic covering.

10. The device according to claim 1, which further comprises a wetting device for wetting the mop cover.

11. The device according to claim 10, which further comprises a drive for moving the holder and the mop cover relative to said first and second pressure elements, along a movement path, said wetting device being disposed upstream of said wringing apparatus along said movement path.

12. The device according to claim 1, wherein the mop has a regenerating device, the mop being a mobile device having its own drive, and the mop automatically starting the regenerating device for automatically regenerating the mop, the mobile device has a housing, a projecting section of the holder for the mop cover projects over the housing, and said pressure elements have a cylinder section pressing on the projecting section of the holder.

13. The device according to one of the claims 12, wherein said pressure elements also have a cylinder section pressing on the mop cover projecting over the holder, and the diameter of said cylinder section pressing on the projecting section of the holder is smaller, by twice the thickness of the holder, than said cylinder section pressing on the mop cover projecting over the holder.

14. The device according to claim 12, which further comprises a device for creating a form-locking contact disposed between said cylinder section pressing on the projecting section of the holder and the projecting section of the holder.

15. The device according to claim 14, wherein said device for creating a form-locking contact is a toothing.

16. The device according to claim 13, wherein at least one of said cylinder sections is mounted independently of the other of said cylinder sections, and a pretensioning device flexibly pretensions said at least one cylinder section in the direction of the holder section.

17. The device according to claim 16, wherein said pretensioning device is a spring.

18. The device according to claim 13, wherein said cylinder section pressing on the holder section is mounted independently of the other of said cylinder sections, and a pretensioning device flexibly pretensions said cylinder section pressing on the holder section in the direction of the holder section.

19. The device according to claim 18, wherein said pretensioning device is a spring.

20. A floor cleaning system, comprising:

a device according to claim 1; and a mop with a flat holder and a mop cover to be fastened to a lower side of the holder.

21. A device for wringing a mop having a flat holder and a mop cover to be fastened to a lower side of the holder for projecting over the holder, the device comprising:

a wringing apparatus having a first pressure element and a second pressure element, said pressure elements cofigured for providing compression of the holder together with the mop cover between said first and second pressure elements for wringing the mop cover;

said first and second pressure elements defining a gap having a decreasing height toward edges of the mop cover, during the compression; and a drive for moving the holder and the mop cover relative to said first and second pressure elements, along a movement path.

* * * * *